US009379432B2

(12) United States Patent
Ishikawa et al.

(10) Patent No.: US 9,379,432 B2
(45) Date of Patent: Jun. 28, 2016

(54) ANTENNA DEVICE, ELECTRONIC APPARATUS, AND WIRELESS COMMUNICATION METHOD

(71) Applicant: FUJITSU LIMITED, Kawasaki-shi, Kanagawa (JP)

(72) Inventors: Shohei Ishikawa, Yokohama (JP); Teruhisa Ninomiya, Yokohama (JP)

(73) Assignee: Fujitsu Limited, Kawasaki (JP)

( * ) Notice: Subject to any disclaimer, the term of this patent is extended or adjusted under 35 U.S.C. 154(b) by 264 days.

(21) Appl. No.: 13/785,963

(22) Filed: Mar. 5, 2013

(65) Prior Publication Data

US 2013/0241792 A1 Sep. 19, 2013

(30) Foreign Application Priority Data

Mar. 19, 2012 (JP) ..... 2012-061689

(51) Int. Cl.

| | |
|---|---|
| ***H01Q 1/24*** | (2006.01) |
| ***H01Q 1/50*** | (2006.01) |
| ***H01Q 1/38*** | (2006.01) |
| ***H01Q 1/52*** | (2006.01) |
| ***H01Q 9/42*** | (2006.01) |
| ***H01Q 21/28*** | (2006.01) |

(52) U.S. Cl.

CPC . *H01Q 1/50* (2013.01); *H01Q 1/38* (2013.01); *H01Q 1/521* (2013.01); *H01Q 9/42* (2013.01); *H01Q 21/28* (2013.01)

(58) Field of Classification Search

CPC ..... H01Q 1/48; H01Q 5/50; H01Q 1/50; H01Q 1/521; H01Q 21/28; H01Q 9/42; H01Q 1/38; H01Q 9/0421

USPC ..... 343/848, 846

See application file for complete search history.

(56) References Cited

U.S. PATENT DOCUMENTS

| | | | | |
|---|---|---|---|---|
| 6,448,933 | B1 * | 9/2002 | Hill et al. | 343/702 |
| 8,115,686 | B2 * | 2/2012 | Mumbru et al. | 343/702 |
| 2007/0001911 | A1 | 1/2007 | Fujio et al. | |
| 2008/0278384 | A1 | 11/2008 | Shimasaki et al. | |
| 2010/0238079 | A1 * | 9/2010 | Ayatollahi et al. | 343/729 |
| 2013/0241792 | A1 * | 9/2013 | Ishikawa et al. | 343/848 |

FOREIGN PATENT DOCUMENTS

| | | | |
|---|---|---|---|
| JP | 2003-332834 | A | 11/2003 |
| JP | 2006-352293 | A | 12/2006 |

(Continued)

OTHER PUBLICATIONS

Extended Search Report issued in European Patent Application No. 13 15 8004, mailed Jun. 20, 2013, 7 pages.

(Continued)

*Primary Examiner* — Michael C. Wimer
*Assistant Examiner* — Noel Maldonado
(74) *Attorney, Agent, or Firm* — Arent Fox LLP

(57) ABSTRACT

An antenna device, includes: a ground plate to which first and second antennas, each including a radiating element and a ground terminal, are connected, with one of the first and second antennas being powered, the ground plate including: a first slit extending from a portion where the ground terminal of one antenna of the first and second antennas is connected to the ground plate, in a direction along to the ground terminal, and a second slit extending from the tip of the first slit in a direction along to the radiating element.

12 Claims, 33 Drawing Sheets

(56) References Cited

FOREIGN PATENT DOCUMENTS

| | | | |
|---|---|---|---|
| JP | 2007-013643 | A | 1/2007 |
| JP | 2008-283464 | A | 11/2008 |

OTHER PUBLICATIONS

Hsieh et al., "Band-stop Filter Design of Coplanar Stripline," Asia-Pacific Microwave Conference, Dec. 11, 2007.

Kim et al., "High isolation Internal Dual-Band Planar Inverted-F Antenna Diversity System with Band-Notched Slots for MIMO Terminals," 36th European Microwave Conference, Sep. 1, 2006, pp. 1414-1417.

Chinese Office Action issued Oct. 8, 2014; Application No. 201310083961.9, with English Translation.

Chinese Office Action for Chinese Application No. 201310083961.9 dated Jun. 3, 2015.

Office Action of Japanese Patent Application No. 2012-061689 dated Oct. 20, 2015. (Partial Translation).

* cited by examiner

ANTENNA DEVICE WITH W1 = 2.5 mm

CORRELATION COEFFICIENT FOR SLIT LENGTH WITH W1 = 2.5 mm

ANTENNA DEVICE WITH W1 = 5 mm

CORRELATION COEFFICIENT FOR SLIT LENGTH WITH W1 = 5 mm

| NAME | PHI | ANG | MAG |
|---|---|---|---|
| m1 | 270.0000 | -90.0000 | 1.1902 |
| m2 | 90.0000 | 90.0000 | 1.2035 |
| m3 | 270.0000 | -90.0000 | -11.8576 |

| NAME | PHI | ANG | MAG |
|---|---|---|---|
| m1 | 270.0000 | -90.0000 | -10.2973 |
| m2 | 90.0000 | 90.0000 | -10.2851 |
| m3 | 270.0000 | -90.0000 | 1.4102 |

GAIN OF VERTICAL POLARIZED WAVES [UNITS: dB]

GAIN OF HORIZONTAL POLARIZED WAVES [UNITS: dB]

| NAME | PHI | ANG | MAG |
|---|---|---|---|
| m1 | 270.0000 | -90.0000 | -2.7978 |
| m2 | 90.0000 | 90.0000 | -2.7820 |
| m3 | 270.0000 | -90.0000 | -0.9905 |

GAIN OF VERTICAL POLARIZED WAVES [UNITS: dB]

GAIN OF HORIZONTAL POLARIZED WAVES [UNITS: dB]

| NAME | PHI | ANG | MAG |
|---|---|---|---|
| m1 | 270.0000 | -90.0000 | -0.2947 |
| m2 | 90.0000 | 90.0000 | -0.2824 |
| m3 | 270.0000 | -90.0000 | -4.7253 |

END VIEW OF LINE A-A

END VIEW OF LINE B-B

END VIEW OF LINE C-C

| NAME | PHI | ANG | MAG |
|---|---|---|---|
| m1 | 270.0000 | -90.0000 | -7.2630 |
| m2 | 90.0000 | 90.0000 | -7.3060 |
| m3 | 270.0000 | -90.0000 | 0.9841 |

| NAME | PHI | ANG | MAG |
|---|---|---|---|
| m1 | 270.0000 | -90.0000 | 1.0185 |
| m2 | 90.0000 | 90.0000 | 1.0849 |
| m3 | 270.0000 | -90.0000 | -9.2515 |

| NAME | PHI | ANG | MAG |
|---|---|---|---|
| m1 | 270.0000 | -90.0000 | -0.8145 |
| m2 | 90.0000 | 90.0000 | -0.6445 |
| m3 | 270.0000 | -90.0000 | -3.2571 |

| NAME | PHI | ANG | MAG |
|---|---|---|---|
| m1 | 270.0000 | -90.0000 | -2.0906 |
| m2 | 90.0000 | 90.0000 | -2.2728 |
| m3 | 270.0000 | -90.0000 | -2.9788 |

| NAME | PHI | ANG | MAG |
|---|---|---|---|
| m1 | 270.0000 | -90.0000 | 0.5923 |
| m2 | 90.0000 | 90.0000 | 0.5526 |
| m3 | 270.0000 | -90.0000 | -21.5728 |

GAIN OF VERTICAL POLARIZED WAVES [UNITS: dB]

GAIN OF HORIZONTAL POLARIZED WAVES [UNITS: dB]

| NAME | PHI | ANG | MAG |
|---|---|---|---|
| m1 | 270.0000 | -90.0000 | -16.2955 |
| m2 | 90.0000 | 90.0000 | -16.2908 |
| m3 | 270.0000 | -90.0000 | 0.9617 |

GAIN OF VERTICAL POLARIZED WAVES [UNITS: dB]

GAIN OF HORIZONTAL POLARIZED WAVES [UNITS: dB]

| NAME | PHI | ANG | MAG |
|---|---|---|---|
| m1 | 270.0000 | -90.0000 | -0.1043 |
| m2 | 90.0000 | 90.0000 | -0.1043 |
| m3 | 270.0000 | -90.0000 | -2.6329 |

GAIN OF VERTICAL POLARIZED WAVES [UNITS: dB]

GAIN OF HORIZONTAL POLARIZED WAVES [UNITS: dB]

| NAME | PHI | ANG | MAG |
|---|---|---|---|
| m1 | 270.0000 | -90.0000 | -1.1779 |
| m2 | 90.0000 | 90.0000 | -1.2191 |
| m3 | 270.0000 | -90.0000 | -1.0947 |

ANTENNA DEVICE, ELECTRONIC APPARATUS, AND WIRELESS COMMUNICATION METHOD

CROSS-REFERENCE TO RELATED APPLICATION

This application is based upon and claims the benefit of priority of the prior Japanese Patent Application No. 2012-061689, filed on Mar. 19, 2012, the entire contents of which are incorporated herein by reference.

FIELD

The embodiments discussed herein are related to antenna technology used for wireless communication, an antenna device which combines multiple antennas, and an electronic apparatus, for example.

BACKGROUND

With information communication according to wireless communication, radio waves propagate in space, and information is transmitted to a communication destination. In this case, a part of radio waves directly reach a reception antenna of the communication destination from a transmission antenna. A part of the radio waves reaches the reception antenna of the communication destination after being reflected at a reflective material such as the ground surface, the wall of a building, or the like. Radio waves which directly reach will be referred to as direct waves. Also, radio waves reflected at the reflective material will be referred to as reflected waves. The direct waves and reflected waves are received at the communication destination together. Thus, received power greatly fluctuates depending on reception positions of the radio waves. This fluctuation is called fading. In order to reduce influence of fading, for example, an arrangement has been implemented where radio waves are received by a diversity antenna device which combines multiple antennas (e.g., see Japanese Laid-open Patent Publication Nos. 2003-332834 and 2006-352293).

SUMMARY

According to an aspect of the invention, an antenna device, includes: a ground plate to which first and second antennas, each including a radiating element and a ground terminal, are connected, with one of the first and second antennas being powered, the ground plate including: a first slit extending from a portion where the ground terminal of one antenna of the first and second antennas is connected to the ground plate, in a direction along to the ground terminal, and a second slit extending from the tip of the first slit in a direction along to the radiating element.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Hereinafter, embodiments will be described with reference to the drawings.

While inventing the present embodiments, observations were made regarding a related art. Such observations include the following, for example.

In antenna technology of a related art, influence of fading may be reduced by receiving radio waves using antennas having different reception properties. In the event of configuring an antenna device by disposing multiple antennas on a ground plate, coupling between antennas increases. Specifically, in the event of having powered one of the antennas, current also flows into the antenna which has not been powered, and undesired radio waves are radiated from the antenna which has not been powered. Therefore, the properties of the antennas resemble each other, and combined effects of the multiple antennas deteriorate. Namely, diversity effects deteriorate.

Therefore, it has been found to be desirable to reduce coupling between multiple antennas disposed on the ground plate.

First Embodiment

Figure 1A:
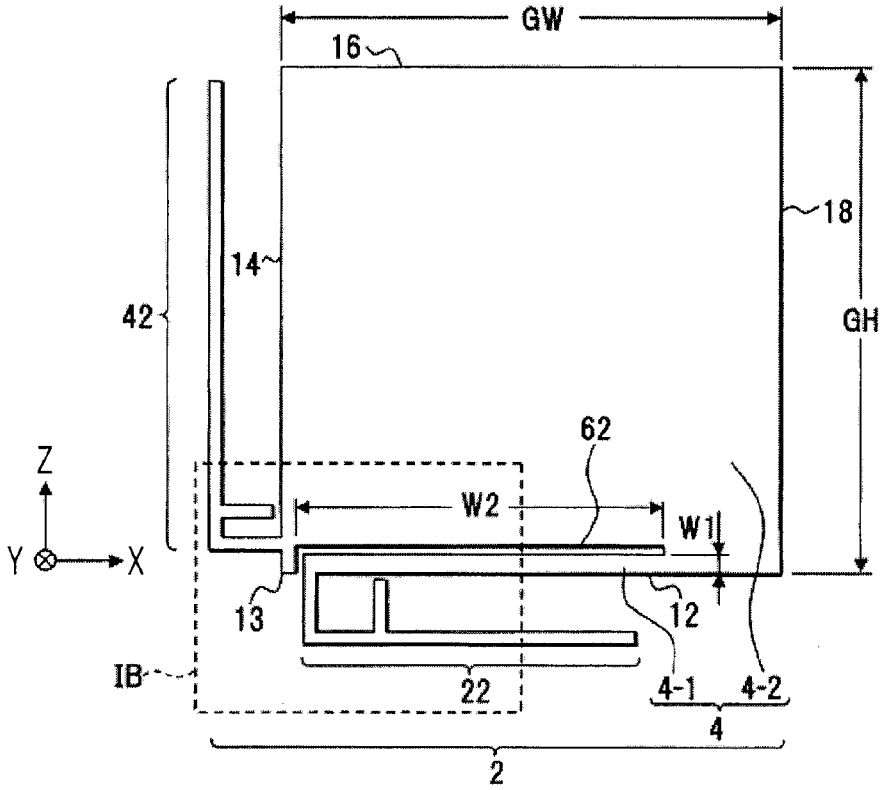
FIGS. 1A and 1B are diagrams illustrating an example of an antenna device according to a first embodiment.
Figure 1B:
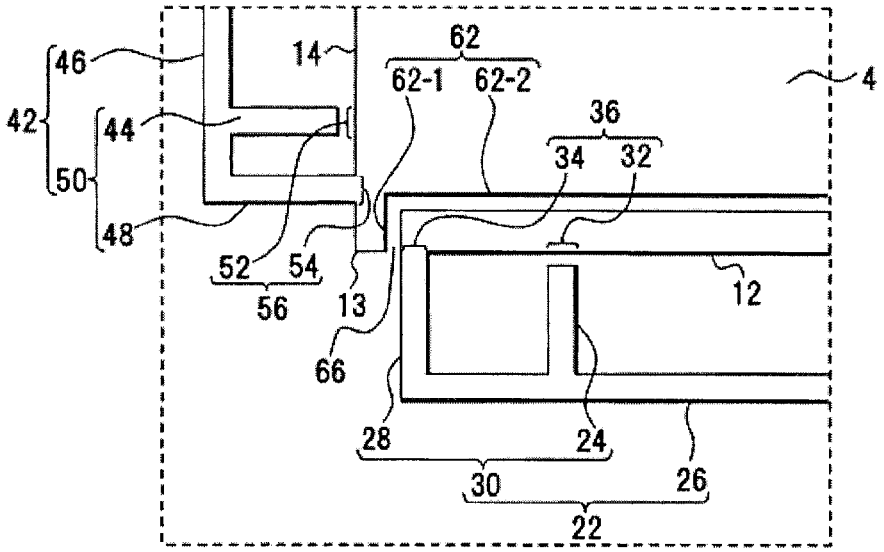

A first embodiment will be described with reference to FIGS. 1A and 1B. FIGS. 1A and 1B are diagrams illustrating an example of an antenna device according to the first embodiment. Note that the configuration illustrated in FIGS. 1A and 1B is an example, and the scope of the present disclosure is not restricted to such a configuration. In FIG. 1A, the horizontal direction in space is taken as the X axis, the vertical direction in space is taken as the Y axis, and the lengthwise direction in space is taken as the Z axis. FIG. 1B is an enlarged diagram of an IB portion illustrated in FIG. 1A.

An antenna device 2 illustrated in FIG. 1 includes a ground plate 4, a first antenna 22, and a second antenna 42. The first antenna 22 and second antenna 42 are disposed in different side portions of the ground plate 4. The antenna device 2 makes up a diversity antenna device where the first antenna 22 and second antenna 42 are disposed on the ground plate 4, for example. For example, the antenna device 2 powers either antenna of the first antenna 22 and second antenna 42 to switch the antenna to be powered.

The ground plate 4 is configured of an electro-conductive material, and has electro-conductivity. The ground plate 4 is configured of metal foil, for example, such as copper foil, aluminum foil, silver foil, or the like. Also, the ground plate 4 may be configured of a metal plate such as a copper plate, an aluminum plate, a silver plate, or the like, for example. The ground plate 4 is, for example, a flat plate, and has a substantially rectangular shape. The ground plate 4 has a first side portion 12, a second side portion 14, a third side portion 16, and a fourth side portion 18. The first side portion 12 faces the third side portion 16, and is adjacent to the second side portion 14 and fourth side portion 18.

The first antenna 22 is disposed in the first side portion 12. The second antenna 42 is disposed in the second side portion 14. Namely, the first antenna 22 and second antenna 42 are each disposed in adjacent side portions which are substantially orthogonal via a corner portion 13.

The first antenna 22 and second antenna 42 are elements configured to at least one of transmit radio waves and receive radio waves. The first antenna 22 and second antenna 42 are configured of metal foil, for example, such as copper foil, aluminum foil, silver foil, or the like. The first antenna 22 and second antenna 42 may be configured of a metal plate such as a copper plate, an aluminum plate, a silver plate, or the like, for example. The first antenna 22 and second antenna 42 have a flat plate shape, for example.

The first antenna 22 includes a first linear element 24, a second linear element 26, and a short-circuit element 28. The first linear element 24 and short-circuit element 28 make up a base 30 of the first antenna 22. The base 30 is disposed in a position in the vicinity of the first side portion 12 closer to the second side portion 14. The first linear element 24 faces an element facing portion 32 of the ground plate 4. The short-circuit element 28 is joined to the ground plate 4 by an element joint portion 34. The element facing portion 32 and element joint portion 34 make up a facing portion 36 facing the base 30 of the antenna 22. Now, the term "vicinity" means that the distance is close, and also includes a contact state, i.e., a case where the distance is 0.

The first linear element 24 is disposed between the first side portion 12 and the second linear element 26, and extends in the substantially vertical direction against the first side portion 12. The first linear element 24 is adjacent to the element facing portion 32 of the ground plate 4, and is connected to the second linear element 26.

The second linear element 26 serves as a radiating element of the first antenna 22. The second linear element 26 extends in the substantially parallel direction against the first side portion 12. The second linear element 26 is connected to the first linear element 24, and also connected to the short-circuit element 28 at one edge portion thereof.

The short-circuit element 28 is an example of the ground terminal of the first antenna 22, disposed between the first side portion 12 and the second linear element 26, and disposed in the vicinity of the first linear element 24. The short-circuit element 28 extends in the substantially vertical direction against the first side portion 12. The short-circuit element 28 is connected to the second linear element 26, and connected to the ground plate 4 by the element joint portion 34. According to this connection, the short-circuit element 28 shorts the first antenna 22 to the ground plate 4. Adjustment of impedance may be performed by adjusting the position of the short-circuit element 28.

The first antenna 22 forms an inverted-F antenna using the first linear element 24, second linear element 26, and short-circuit element 28. In the event that a power feeder is connected to the first linear element 24, and a ground line is connected to the element facing portion 32, the first antenna 22 serves as an antenna.

The second antenna 42 includes a first linear element 44, a second linear element 46, and a short-circuit element 48. The first linear element 44 and short-circuit element 48 make up a base 50 of the second antenna 42. The base 50 is disposed in a position in the vicinity of the second side portion 14 closer to the first side portion 12. The first linear element 44 faces an element facing portion 52 of the ground plate 4. The short-circuit element 48 is joined to the ground plate 4 by an element joint portion 54. The element facing portion 52 and element joint portion 54 make up a facing portion 56 facing the base 50 of the antenna 42.

The first linear element 44 is disposed between the second side portion 14 and the second linear element 46, and extends in the substantially vertical direction against the second side portion 14. The first linear element 44 is adjacent to the element facing portion 52 of the ground plate 4, and is connected to the second linear element 46.

The second linear element 46 serves as a radiating element of the second antenna 42. The second linear element 46 extends in the substantially parallel direction to the second side portion 14. The second linear element 46 is connected to the first linear element 44, and also connected to the short-circuit element 48 at one edge portion thereof.

The short-circuit element 48 is an example of the ground terminal of the second antenna 42, disposed between the second side portion 14 and the second linear element 46, and disposed in the vicinity of the first linear element 44. The short-circuit element 48 extends in the substantially vertical direction against the second side portion 14. The short-circuit element 48 is connected to the second linear element 46, and connected to the ground plate 4 by the element joint portion 54. According to this connection, the short-circuit element 48 shorts the second antenna 42 to the ground plate 4. Adjustment of impedance may be performed by adjusting the position of the short-circuit element 48.

The second antenna 42 forms an inverted-F antenna using the first linear element 44, second linear element 46, and short-circuit element 48. In the event that a power feeder is connected to the first linear element 44, and a ground line is connected to the element facing portion 52, the second antenna 42 serves as an antenna.

A slit 62 is formed in the ground plate 4. The slit 62 forms an elongated notch for the ground plate 4, and forms a non-electro-conductive portion. The slit 62 forms an opening 66 in the first side portion 12 in an adjacent portion adjacent to the element joint portion 34. For example, the slit 62 forms an opening 66 in a joint portion where the ground terminal of the first antenna 22 is joined to the ground plate 4. This opening 66 is formed closer to the first antenna 22 side than the element joint portion 34, for example. The slit 62 extends to the inner side, i.e., inward of the ground plate 4 from the opening 66 to form a slit 62-1. This slit 62-1 is an example of a first slit, and extends in a substantially parallel direction to the first linear element 24 and short-circuit element 28. The slit 62 substantially orthogonally bends at a position of length W1 mm from the first side portion 12. The slit 62 extends in the substantially parallel direction to the first side portion 12 after bending to form a slit 62-2. Namely, the slit 62-2 is an example of a second slit, and extends along the first side portion 12, where the first antenna 22 is disposed, and the second linear element 26. The slit 62-2 has length W2 mm. A ground plate 4-1 around the first side portion 12 is surrounded in two directions by the slit 62, and is separated from another ground plate 4-2. Therefore, the ground plate 4-1 is connected to the other ground plate 4-2 bypassing the slit 62.

The circumference of the facing portion 56 side of the facing portion 36 is surrounded by the slit 62. Therefore, the facing portion 36 and facing portion 56 are connected bypassing the slit 62, and coupling between the first antenna 22 and the second antenna 42 is suppressed. In the event of feeding the first antenna 22 or second antenna 42, high-frequency current on the powered side is suppressed from flowing into the other antenna.

The antenna device 2 is disposed so that the X-Y plane agrees with the horizontal plane, for example. In this case, the first antenna 22 becomes an antenna which principally receives vertical polarized waves. Also, the second antenna 42 becomes an antenna which principally receives horizontal polarized waves. Namely, the two antennas 22 and 42 having different properties are disposed in antenna device 2. Each of the antennas 22 and 42 receives radio waves of which the polarized waves differ. Thus, the antenna device 2 makes up a polarized-wave diversity antenna device. The antenna device 2 enables radio waves of either polarized waves to be received by combining with a switching unit such as a changeover switch, and switching the antenna to be used.

(1) Power Distribution of Antenna Device

Figure 2A:
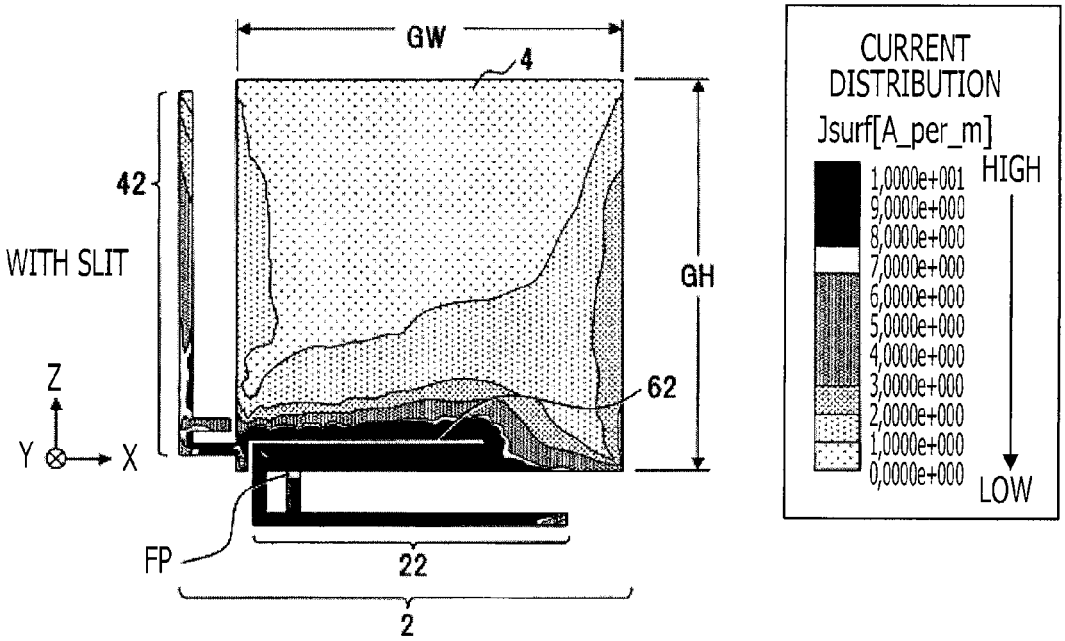
FIGS. 2A and 2B are diagrams illustrating an example of a current distribution of the antenna device.
Figure 2B:
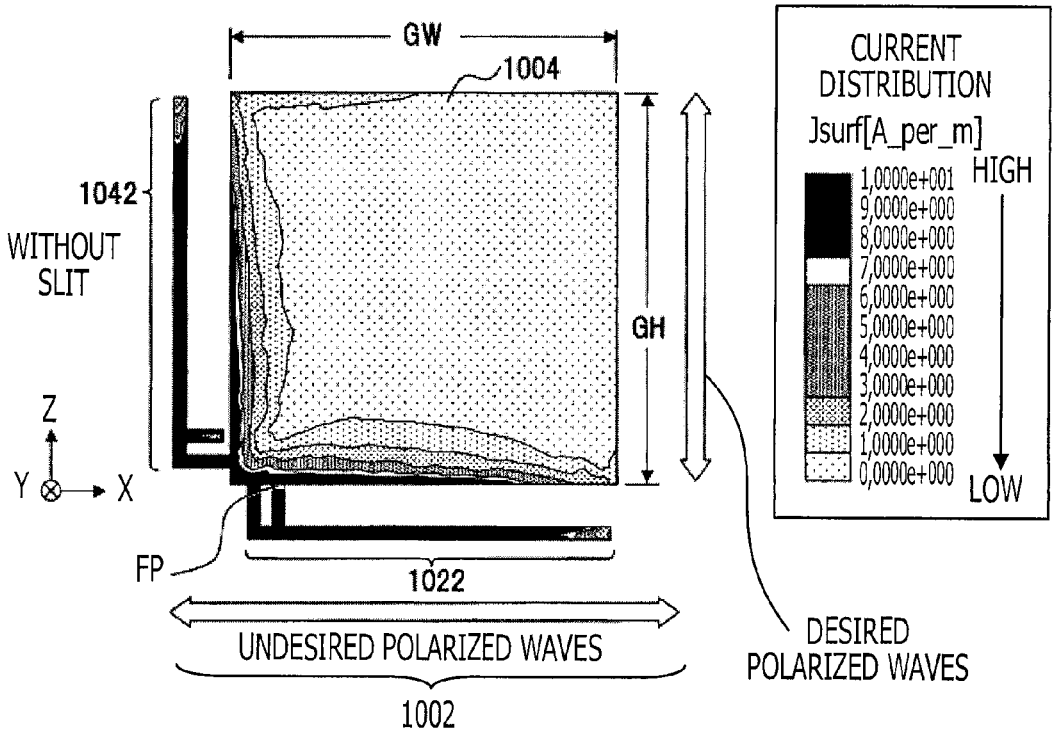

Next, a power distribution of the antenna device 2 will be described with reference to FIGS. 2A and 2B. FIG. 2A is a diagram illustrating an example of a current distribution of an antenna device where slits are provided in the ground plate. FIG. 2B is a diagram illustrating an example of a current distribution of an antenna device where no slit is provided in the ground plate. Note that the current distributions illustrated in FIGS. 2A and 2B are current distributions in the event that the antenna devices have been disposed in free space, the first antennas 22 and 1022 have been powered, and represent current distributions on the ground plate and antenna. These current distributions are obtained by simulation analysis. Note that such current distributions are an example, and the present disclosure is not restricted to such current distributions.

The antenna device 2 illustrated in FIG. 2A is an antenna device having the same shape as the antenna device 2 illustrated in FIG. 1. Example parameters of the antenna device 2 may be as follows.

Vertical Dimension of Ground Plate: GH: 70 mm
Horizontal Dimension of Ground Plate GW: 70 mm
Thickness of Metal: 0.4 mm
Width of Slit: 1 mm
Length of Slit: 0.16λ

λ represents the wavelength of radio waves to be transmitted or received. Radio waves of 1 GHz are employed as an analysis frequency. In this case, 0.16 wavelength (0.16λ) becomes around 48 mm.

The lengths of the first antenna 22 and second antenna 42 are set to a length for receiving radio waves for an analysis frequency. The first antenna 22 and second antenna 42 are inverted-F antennas. Therefore, the antenna length is basically set to ¼ wavelength. The length of the first antenna 22 is set to be shorter than the length of the second antenna 42 since the slit 62 is disposed on the first antenna element 22 side. Namely, the slit 62 is disposed adjacent to the base 30 of the first antenna 22, thereby realizing reduction of the length of the antenna wire.

With respect to antenna device 1002 illustrated in FIG. 2B, no slit is provided to a ground plate 1004. A first antenna 1022 and a second antenna 1042 are disposed for the ground plate 1004 and the lengths of the first antenna 1022 and second antenna 1042 are set to a length for receiving radio waves of an analysis frequency. The antenna length is basically set to ¼ wavelength. The wire length of the first antenna 1022 is longer than that of the first antenna 22 since there is no slit in the ground plate 1004.

The current distribution illustrated in FIG. 2A is a current distribution in the event of having powered a feeding position FP of the first antenna 22. In this case, vertical polarized waves are received as desired polarized waves, and horizontal polarized waves become undesired polarized waves. The current distribution is high at the powered first antenna 22 and slit 62. On the other hand, the current distribution is low at the second antenna 42 as compared to the first antenna 22.

Namely, the amount of current which flows into an unpowered antenna is reduced, and radiation of radio waves of undesired polarized waves is suppressed.

The current distribution illustrated in FIG. 2B is a current distribution in the event of having powered the feeding position FP of the first antenna 1022. The current distribution is high at the powered first antenna 1022 and unpowered second antenna 1042.

In the event that there is no slit, current flows into the unpowered antenna, and sensitivity is also high in a direction of undesired polarized waves. Correlation between the first antenna 1022 and the second antenna 1042 is high. In comparison, in the event that there is a slit 62, flowing current into the antenna on the unpowered side is suppressed. Correlation between the first antenna 22 and the second antenna 42 is low.

The slit 62 suppresses flowing of current into the other antenna. Alternatively, the slit 62 consumes energy generated at the antenna device 2. According to layout of such a slit 62, the amount of current flowing into the other antenna is reduced.

(2) Correlation Coefficient

Figure 3:
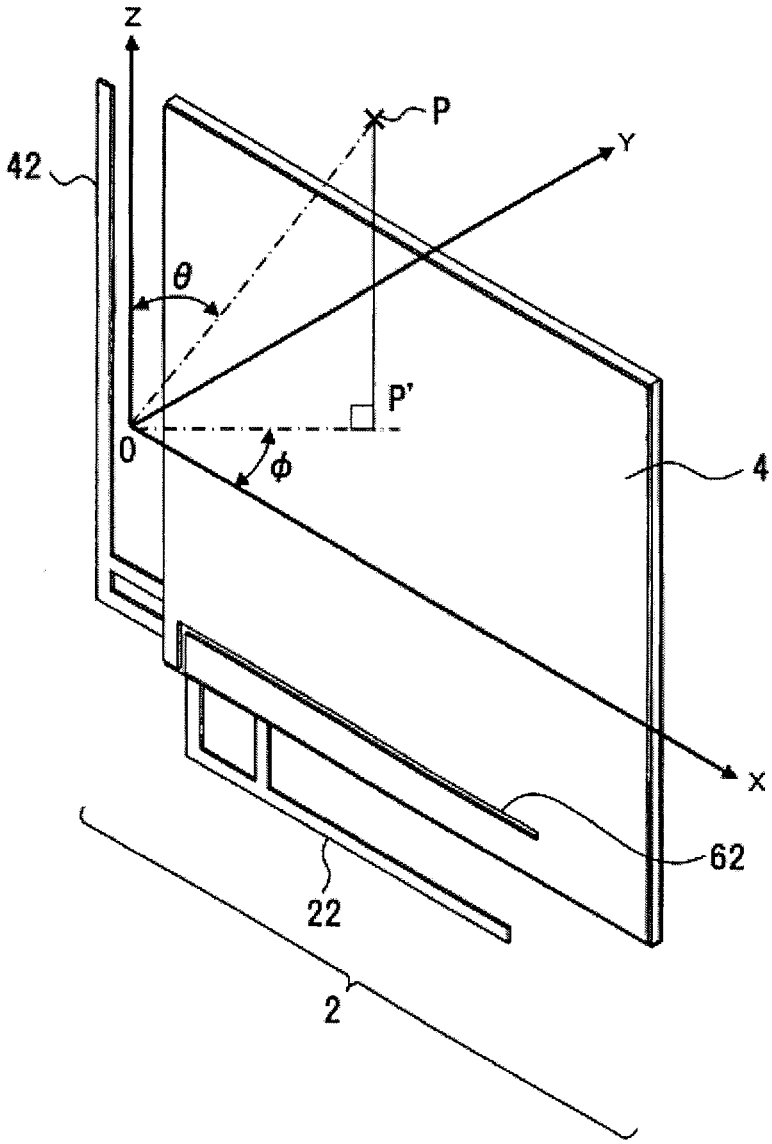
FIG. 3 is a diagram illustrating an example of a coordinate system in calculation of a correlation coefficient.

Next, a correlation efficient will be described with reference to FIG. 3. FIG. 3 is a diagram illustrating an example of a coordinate system in calculation of a correlation coefficient. FIG. 3 represents θ and ϕ in the XYZ coordinate system. ϕ at a point P on space is an angle made up of the Z axis and a line OP. Also, a point obtained by projecting the point P on the X-Y plane is taken as a point P', and ϕ at the point P is an angle made up of the X axis and a line OP'. Note that a point O represents the origin (0, 0, 0) in the XYZ coordinate system.

A correlation coefficient is a coefficient representing the degree of relationship between two variables or phenomena, and is used for representing the degree of relationship between the antennas making up the diversity antenna. The smaller the value of the correlation coefficient is, the smaller the degree of relationship is. Namely, the smaller a correlation coefficient is, the greater the diversity effects are. A correlation coefficient is calculated by Expression 1, for example.

Numerical Expression 1

$$\text{Correlation Coefficient} = \sum_{n=1}^{N} \frac{\sum_{m=1}^{M} \{E_{1\theta}(\theta,\phi)\cdot E_{2\theta}^{*}(\theta,\phi) + E_{1\phi}(\theta,\phi)\cdot E_{2\phi}^{*}(\theta,\phi)\}}{\sum_{m=1}^{M}\left[\begin{array}{l}\{E_{1\theta}(\theta,\phi)\cdot E_{1\theta}^{*}(\theta,\phi) + E_{1\phi}(\theta,\phi)\cdot E_{1\phi}^{*}(\theta,\phi)\}\cdot \\ \{E_{2\theta}(\theta,\phi)\cdot E_{2\theta}^{*}(\theta,\phi) + E_{2\phi}(\theta,\phi)\cdot E_{2\phi}^{*}(\theta,\phi)\}\end{array}\right]} \quad (1)$$

A correlation coefficient of the antenna device 2 illustrated in FIG. 3 will be calculated. The antenna device 2 has a flat plate shape, where the ground plate 4, and antennas 22 and 42 are disposed on the X-Z plane. In the event of obtaining a correlation coefficient of an average of all directions (360 degrees) of the X-Y plane of this antenna device 2, the parameters of Expression 1 become as follows.

N represents the number of planes for calculating a correlation coefficient. A correlation coefficient may be calculated using two planes of the X-Y plane and the Y-Z plane, for example. In the event of calculating a correlation coefficient using the two planes, N=2 holds.

M represents the number of measurement points within each plane. A correlation coefficient may be calculated regarding one rotation (360 degrees) assuming angle steps in units of 5 degrees, for example. In the event of calculating a correlation coefficient regarding one rotation as units of 5 degrees, M=72 holds.

$E_1\theta(\theta, \phi)$: θ component of the electric field in the first antenna $E_1\phi$ (θ, ϕ: ϕ component of the electric field in the first antenna $E_2\theta(\theta, \phi)$: θ component of the electric field in the second antenna $E_2\phi$ (θ, ϕ: ϕ component of the electric field in the second antenna E* represents complex conjugate of E (θ, ϕ) represents an angle in the spherical coordinates. For example, in the event of calculating a correlation coefficient using the Y-Z plane, ϕ=90 degrees holds, and θ varies from 0 degree to 360 degrees, for example.

(3) Relationship Between Slit Length and Correlation Coefficient

Figure 4A:
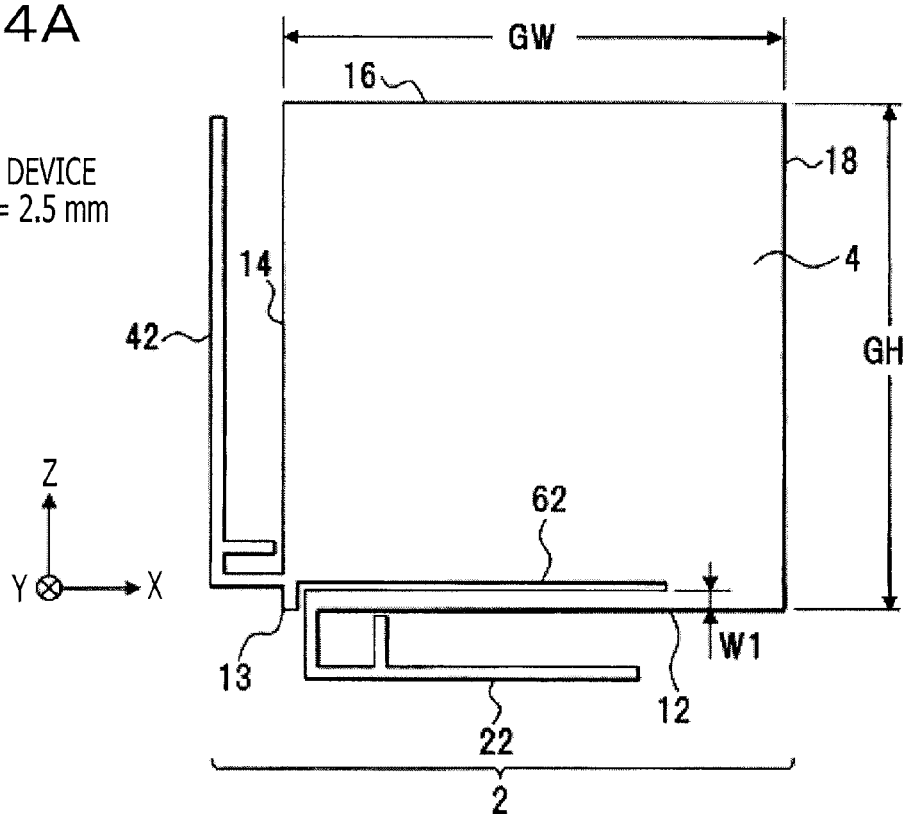
FIGS. 4A and 4B are diagrams illustrating an example of a relation between slit length and a correlation coefficient.
Figure 4B:
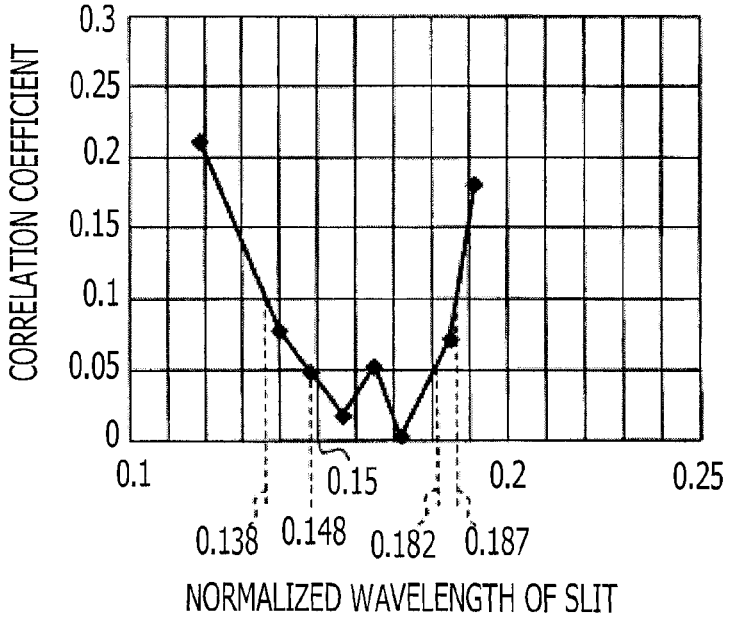
Figure 5A:
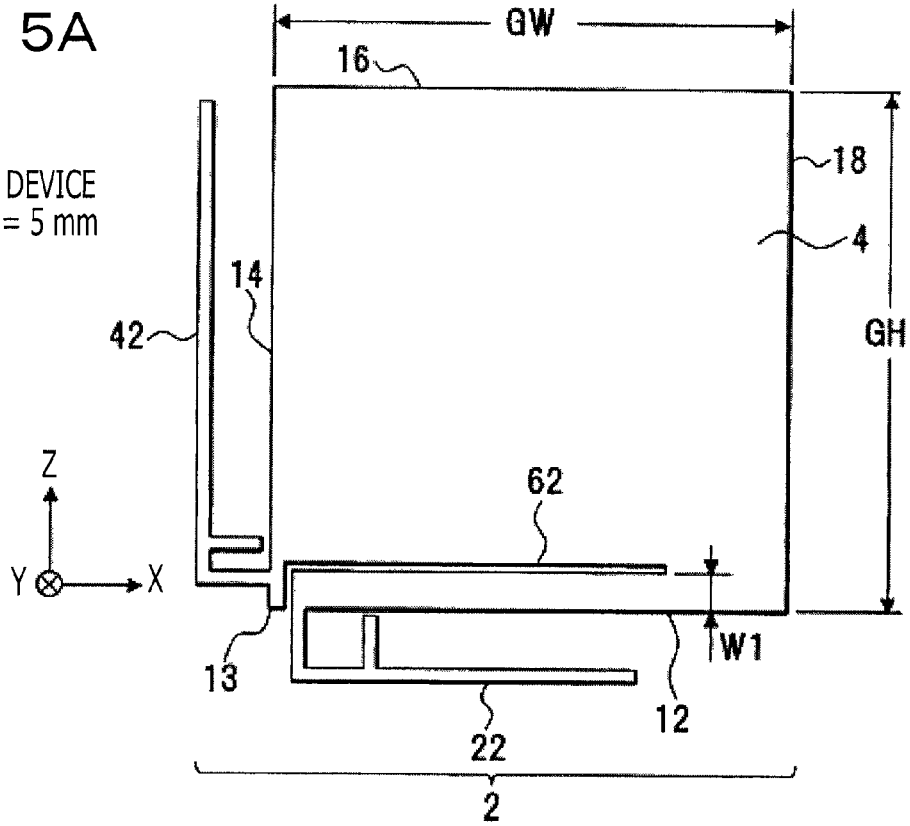
FIGS. 5A and 5B are diagrams illustrating an example of a relation between slit length and a correlation coefficient.
Figure 5B:
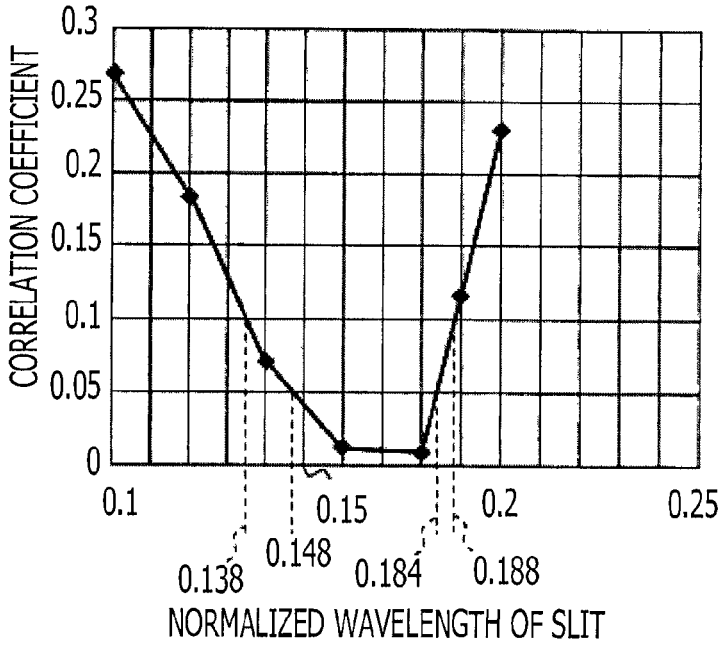
Figure 6A:
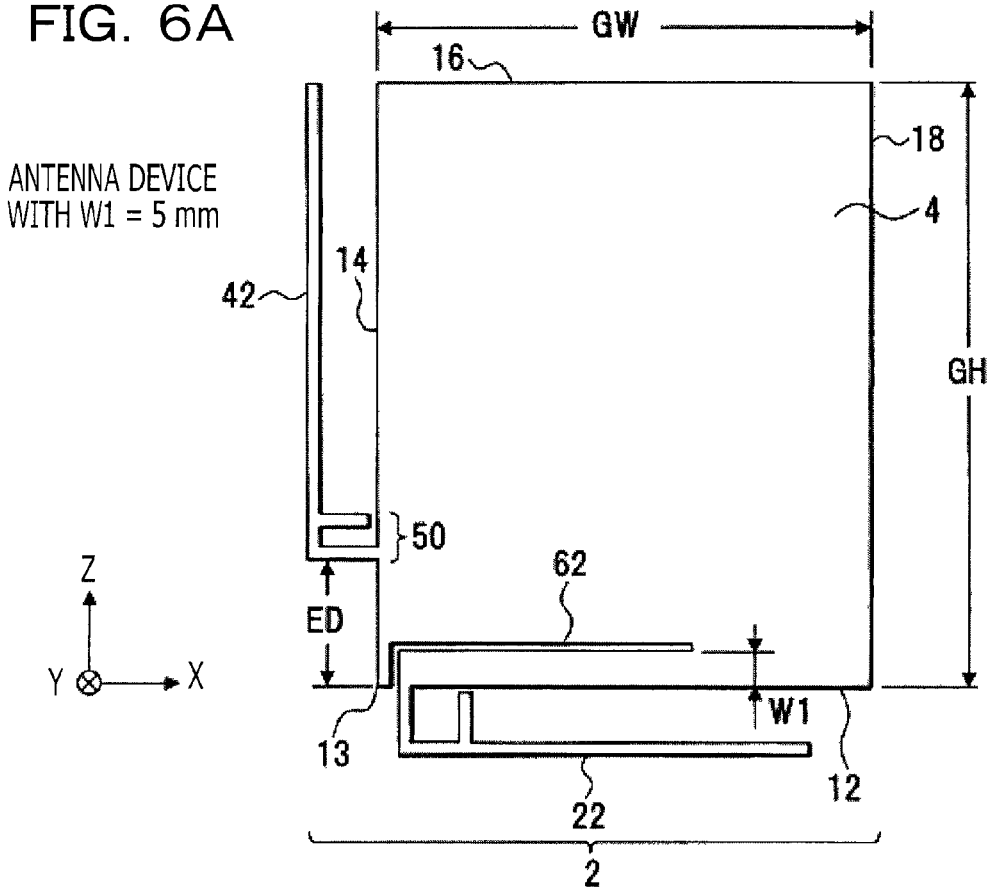
FIGS. 6A and 6B are diagrams illustrating an example of a relation between slit length and a correlation coefficient.
Figure 6B:
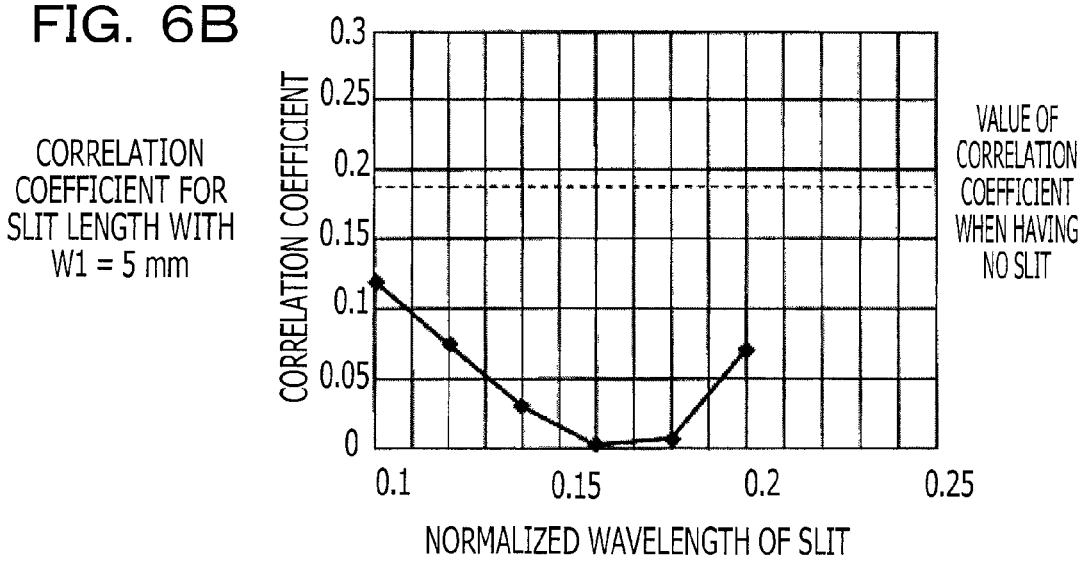

Next, the length of the slit (slit length) will be described with reference to FIGS. 4A, 4B, 5A, 5B, 6A, and 6B. FIG. 4A is a diagram illustrating an example of an antenna device of which the distance W1 is 2.5 mm. FIG. 4B is a diagram illustrating an example of relationship between the slit length of the antenna device in FIG. 4A and a correlation coefficient. FIG. 5A is a diagram illustrating an example of an antenna device of which the distance W1 is 5 mm. FIG. 5B is a diagram illustrating an example of relationship between the slit length of the antenna device in FIG. 5A and a correlation coefficient. FIG. 6A is a diagram illustrating an example of another antenna device of which the distance W1 is 5 mm. FIG. 6B is a diagram illustrating an example of relationship between the slit length of the antenna device in FIG. 6A and a correlation coefficient. In the graphs illustrated in FIGS. 4B, 5B, and 6B, the vertical axis is a correlation coefficient (Correlation Coefficient), and the horizontal axis is slit length. Slit length is represented as the normalized wavelength of the slit (Normalized Wavelength of Slit). Slit length W is a length of, as illustrated in FIG. 1, a total of the length (W1) of the slit 62-1, and the length (W2) of the slit 62-2. Namely, the slit length W is obtained as W=W1+W2.

In the antenna device 2 illustrated in FIG. 4A, which is an example of the antenna device 2 illustrated in FIG. 1, the distance W1 is 2.5 mm. Other example parameters of the antenna device 2 may be as follows.

Vertical Dimension of Ground Plate: GH: 70 mm

Horizontal Dimension of Ground Plate GW: 70 mm

Thickness of Metal: 0.4 mm

Width of Slit: 1 mm

The lengths of the first antenna 22 and second antenna 42 are adjusted so as to receive radio waves of an analysis frequency.

Note that the units of length (meter or m, for example) may be replaced with normalized wavelength. In the event that the analysis frequency is 1 GHz, 0.1 wavelength (0.1λ) is around 30 mm.

As for calculation of a correlation coefficient, an analyzer according to simulation is employed. The following values are set as analysis conditions.

Analysis Frequency: 1 GHz

Medium: Analysis assuming in vacuum

With respect to the analysis results illustrated in FIG. 4B, the correlation coefficient is equal to or less than 0.1 in a range of 0.138λ to 0.187λ in slit length, and accordingly, correlation between the antennas is low. The correlation coefficient is equal to or less than 0.05 in a range of 0.148λ to 0.182λ in slit length, and accordingly, correlation between the antennas is even lower.

In the antenna device 2 illustrated in FIG. 5A, which is an example of the antenna device 2 illustrated in FIG. 1, the distance W1 is 5 mm. The other parameters of the antenna device 2 may be the same as those of the antenna device illustrated in FIG. 4A. Also, the analysis conditions of the correlation coefficients are the same as the analysis conditions of the antenna device 2 illustrated in FIG. 4A.

The lengths of the first antenna 22 and second antenna 42 are adjusted so as to receive radio waves of an analysis frequency.

With respect to the analysis results illustrated in FIG. 5B, the correlation coefficient is equal to or less than 0.1 in a range of 0.135λ to 0.188λ in slit length, and accordingly, correlation between the antennas is low. The correlation coefficient is equal to or less than 0.05 in a range of 0.146λ to 0.184λ in slit length, and accordingly, correlation between the antennas is even lower. Moreover, the correlation coefficient is the lowest in a range of 0.16λ to 0.18λ in slit length.

The antenna device 2 illustrated in FIG. 6A is an example of the antenna device 2 illustrated in FIG. 1 where the distance W1 is 5 mm. Also, the base 50 of the second antenna 42 is disposed in a position separated from the corner portion 13 by around separation distance ED. With this antenna device 2, ED is set as ED=0.05λ. The other parameters of the antenna device 2 may be the same as those of the antenna device illustrated in FIG. 4A. Also, the analysis conditions of the correlation coefficients are the same as the analysis conditions of the antenna device 2 illustrated in FIG. 4A.

The lengths of the first antenna 22 and second antenna 42 are adjusted so as to receive radio waves of an analysis frequency.

The second antenna 42 may be separated from the corner portion 13 by around a separation distance ED, and accordingly, with the analysis results illustrated in FIG. 6B, the correlation coefficient is low as compared to the analysis results in FIGS. 4B and 5B. With respect to the analysis results illustrated in FIG. 6B, the correlation coefficient is equal to or less than 0.12 in a range of 0.1λ to 0.2λ in slit length, and accordingly, correlation between the antennas is low. The correlation coefficient is the lowest in a range of 0.16λ to 0.18λ in slit length.

From the analysis results illustrated in FIGS. 4B, 5B, and 6B, there is a combination to lower the correlation coefficient in a total length of the lengths of the two slits, i.e., in a range of 0.1 to 0.2 wavelength. For example, in the event that the slit length is in a range of 0.16 to 0.18 wavelength, the correlation coefficient is low even if the W1 is either of 2.5 mm and 5 mm. In the event that the slit length is in a range of 0.16 to 0.18 wavelength, the correlation coefficient is low even when increasing the separation distance ED.

Figure 7A:
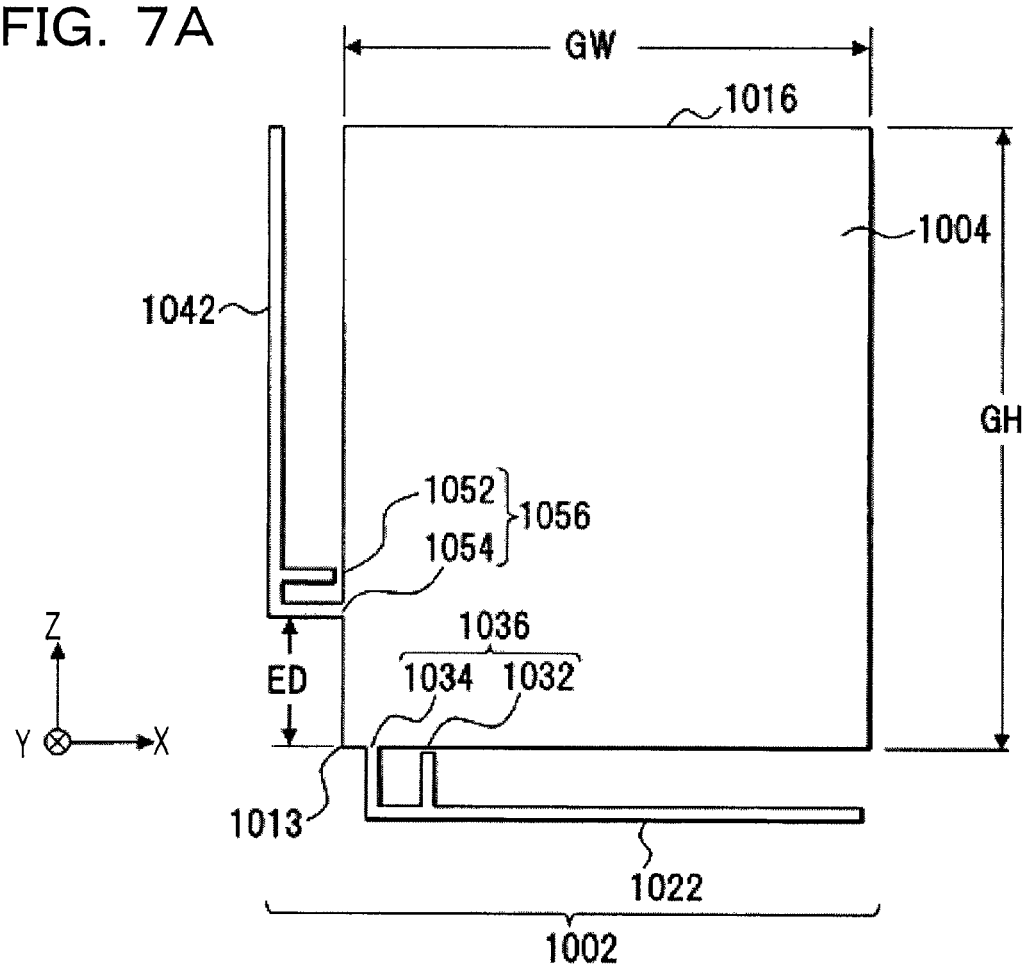
FIGS. 7A and 7B are diagrams illustrating an example of a relation between separation distance and a correlation coefficient.
Figure 7B:
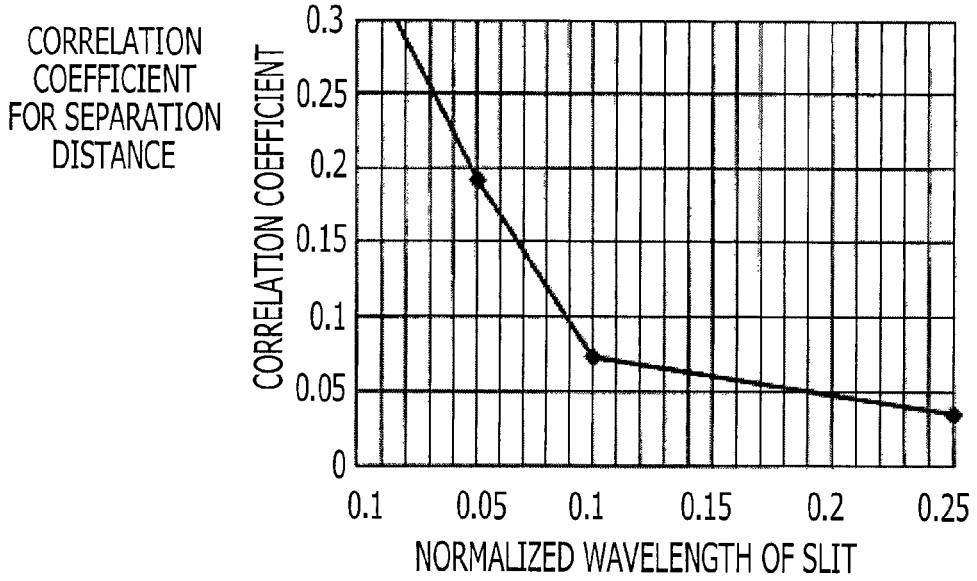

(4) Relationship Between Separation Distance of Antenna and Correlation Coefficient Next, a relationship between the separation distance of the antenna and the correlation coefficient will be described with reference to FIGS. 7A and 7B. FIG. 7A is a diagram illustrating an example of an antenna device including no slit. FIG. 7B is a diagram illustrating an example of the separation distance of the antenna device illustrated in FIG. 7A and the correlation coefficient. In the graph illustrated in FIG. 7B, the vertical axis is the correlation coefficient (Correlation Coefficient), and the horizontal axis is separation distance. Separation distance is represented as Normalized Wavelength of Distance.

The antenna device 1002 illustrated in FIG. 7A is an antenna device in which no slit is provided. The lengths of a first antenna 1022 and a second antenna 1042 are adjusted so as to receive radio waves of an analysis frequency. The vertical dimension GH of a ground plate 1004 is adjusted so that the tip portion of the second antenna 1042 does not protrude from an extended line of a third side portion 1016 of the ground plate 1004. Note that separation distance ED is the distance between a corner portion 1013 and the side edge portion of the corner portion 1013 of a facing portion 1056. A facing portion 1036 is provided in the vicinity of the corner portion 1013. Accordingly, the separation distance ED represents a gap between the antennas. The other parameters of the antenna device 1002 may be the same as those of the antenna device 2 illustrated in FIG. 4A. Also, the analysis conditions of the correlation coefficients are the same as the analysis conditions of the antenna device 2 illustrated in FIG. 4A.

With respect to the analysis results illustrated in FIG. 7B, in order to set the correlation coefficient to be equal to or less than 0.1, the separation distance may be set to be equal to or greater than 0.09λ. In order to set the correlation coefficient to be equal to or less than 0.05, the separation distance may be set to be equal to or greater than 0.19λ. As compared to a case of increasing the separation distance ED, providing a slit may increase the deterioration amount of the correlation coefficient. Also, for example, even when the separation distance ED is relatively separated, such as 0.05λ or the like, the correlation coefficient may further be deteriorated by providing a slit.

With regard to the above-mentioned first embodiment, particular features, advantages, modifications, and so forth will be listed.

(1) As described above, the antenna device 2 includes the two inverted-F antennas. The slit 62 includes a slit 62-1 which extends from the root portion of one of the inverted-F antennas, e.g., a joint portion where the ground terminal of one of the antennas is joined to the ground plate 4 in a direction parallel to the ground terminal of the antenna thereof. The root of the inverted-F antenna specifies an adjacent portion adjacent to the facing portion 36, for example. Also, a slit may be disposed in the facing portion 36 as the root of the inverted-F antenna. The slit 62 includes a slit 62-1 notched in the vertical direction against the first side portion 12, and a slit 62-2 extending substantially parallel to the first side portion 12 of the ground plate 4. The slit 62-1 also extends substantially parallel to the second antenna serving as the radiating element of one of the inverted-F antennas.

(2) The antenna device 2 includes a slit in the root of one of the antennas, thereby significantly decreasing coupling between the antennas. Namely, the correlation coefficient of the antenna device 2 becomes a low value. Thus, the antenna device 2 suppresses current from flowing into the antenna on the non-powered side. Namely, diversity effects will be enhanced. In the event of disposing an antenna which receives different polarized waves, polarized wave diversity effects will be enhanced.

(3) With regards to the first embodiment, though the opening 66 has been formed on the second antenna 42 side closer to the element joint portion 34, and all areas of the facing portion 36 have been surrounded by the slit 62, the antenna device according to the present disclosure is not restricted to such a configuration. For example, an arrangement may be made wherein the opening 66 is formed between the element facing portion 32 and the element joint portion 34, and the slit 62 surrounds the element facing portion 32. In this case, even when the slit 62 surrounds a portion of the facing portion 36, coupling between the antennas is decreased. When changing the layout of the slit, the impedance property of the antenna is changed. Therefore, the slit may be employed as an adjuster of the impedance property. With respect to the antenna device 2, flexibility of adjustment of the impedance property may be improved by adjusting the layout of the slit.

(4) In this way, the slit is provided, whereby coupling between the antennas may be suppressed, and a polarized wave diversity antenna which is small but low in the correlation coefficient may be provided.

(5) In the first embodiment, though the inverted-F antenna has been employed, another antenna which is employed in combination with a ground plate may be employed. For example, the antenna device 2 may be an inverted-L antenna or monopole antenna. In the antenna device 2, antennas having a different type selected from unbalanced feed antennas such as an inverted-F antenna, inverted-L antenna, and monopole antenna, and so forth may be combined and disposed. In the event of employing an unbalanced feed antenna, as compared to an antenna device employing a balanced feed antenna such as a dipole antenna or the like, the antenna device 2 may be reduced in size.

(6) With regards to the first embodiment, though the antenna device 2 has been configured of the first and second antennas 22 and 42, and the ground plate 4, the antenna device according to the present disclosure is not restricted to such a configuration. For example, the antenna device 2 including a dielectric board may be configured by disposing the first and second antennas 22 and 42, and the ground plate 4 on a dielectric board. As for the dielectric board, an FR4 (Flame Retardant Type 4) board may be employed, for example. The FR4 board is obtained by impregnating glass fiber clothing with an epoxy resin, and then subjecting this to heat curing. With respect to the dielectric board, the permittivity ($\in r$) may be 4.4, and the dielectric tangent ($\tan \delta$) may be 0.02, for example. Also, the thickness of the dielectric board may be 0.8 mm, for example.

Second Embodiment

Figure 8A:
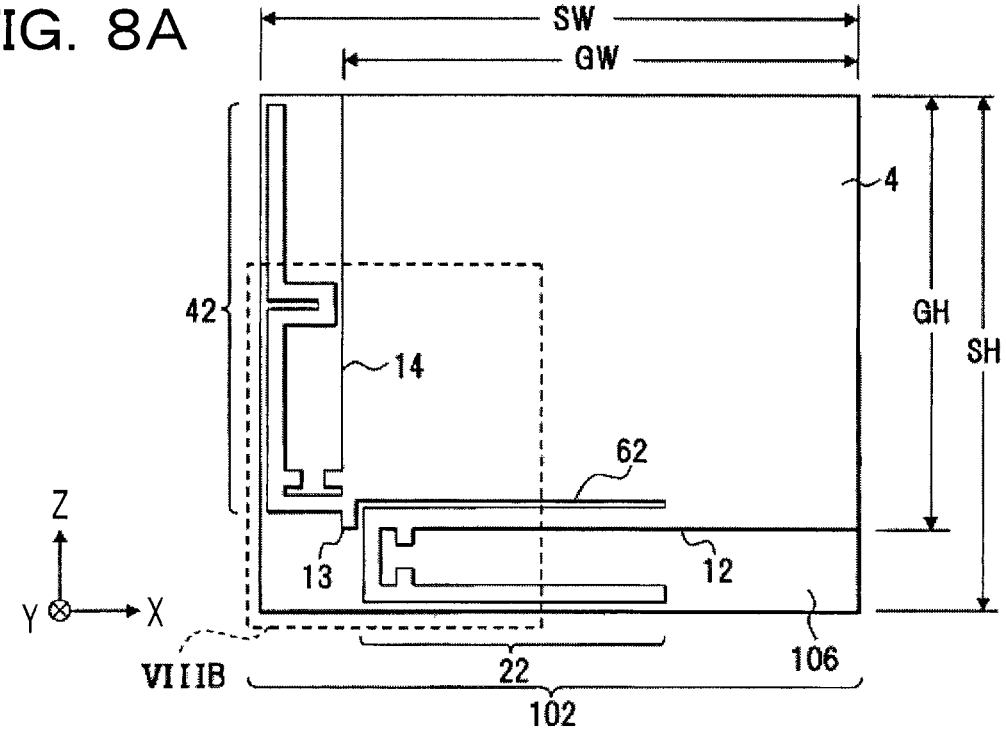
FIGS. 8A and 8B are diagrams illustrating an antenna device according to a second embodiment.
Figure 8B:
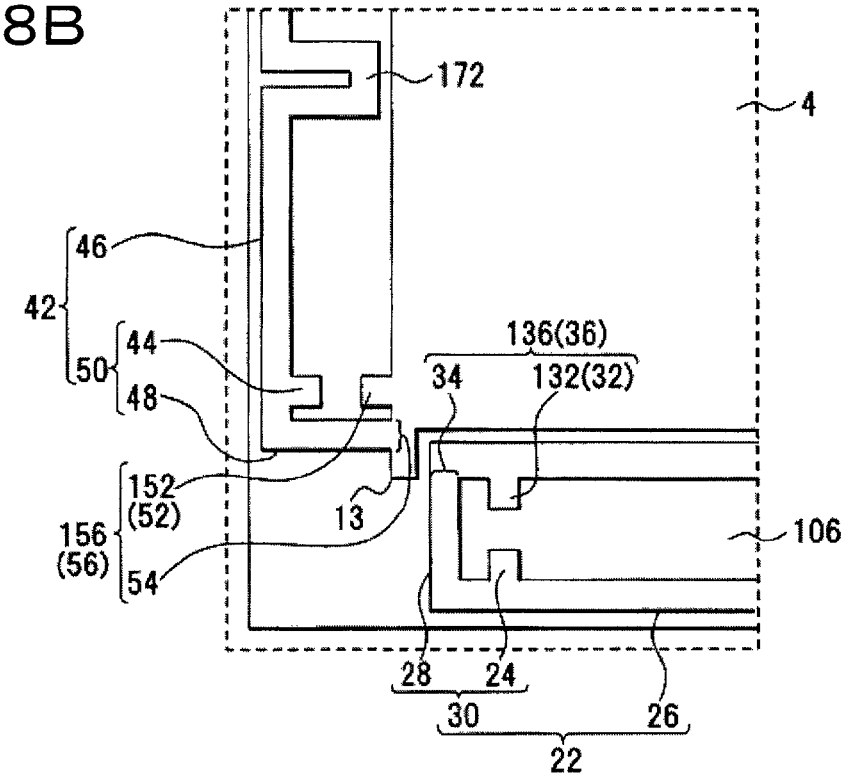

A second embodiment will be described with reference to FIGS. 8A and 8B. FIGS. 8A and 8B are diagrams illustrating an example of an antenna device according to the second embodiment. Note that the configuration illustrated in FIGS. 8A and 8B is an example, and the scope of the present disclosure is not restricted to such a configuration. With respect to FIGS. 8A and 8B, the horizontal direction in space is taken as the X axis, the vertical direction in space is taken as the Y axis, and the lengthwise direction in space is taken as the Z axis. FIG. 8B is an enlarged view of a VIIIB portion illustrated in FIG. 8A.

An antenna device 102 illustrated in FIGS. 8A and 8B includes a dielectric board 106 where the vertical dimension is SH, and the horizontal dimension is SW, and the first antenna 22, second antenna 42, and ground plate 4 are disposed on the dielectric board 106.

The dielectric board 106 is an inductive board, and the already described FR4 board may be employed, for example. The dielectric board 106 may have a configuration wherein multiple insulating layers are laminated by interposing an electro-conductive layer. The insulating layers are materials in which glass fiber clothing is impregnated with an epoxy resin, for example. The electro-conductive layers are metal foil, for example, such as copper foil, aluminum foil, silver foil, or the like. With respect to the dielectric board 106, when disposing an electro-conductive layer subjected to patterning, a circuit may internally be formed. For example, an arrangement may be made wherein an electronic component is disposed on the dielectric board 106, and the electronic component is wired with a circuit within the dielectric board 106. With respect to the antenna device 102, the slit 62 is disposed around the ground plate 4. Therefore, a great area of the ground plate 4 may be secured, which excels in layout flexibility of electronic components. With respect to the dielectric board 106, the permittivity ($\in r$) may be 4.4, and the dielectric tangent ($\tan \delta$) may be 0.02, and the thickness may be 0.8 mm, for example. When employing the dielectric board 106, an electronic component may be disposed on the board surface. Also, the first antenna 22, second antenna 42, and ground plate 4 may be connected to an electronic apparatus such as a wireless communication apparatus or the like via the dielectric board 106. The first antenna 22, second antenna 42, and ground plate 4 may readily be implemented in an electronic apparatus.

The antennas 22 and 42, and ground plate 4 are disposed on one surface of the dielectric board 106, for example. Also, an arrangement may be made wherein the antennas 22 and 42 are disposed on one surface of the dielectric board 106, and the ground plate 4 is disposed on both surfaces of one surface of the dielectric board 106, and the surface facing this surface. When disposing the ground plate 4 on both surfaces, the ground plate 4 may be expanded to almost twice the area of the ground plate 4.

The ground plate 4 is metal foil, for example, such as copper foil, aluminum foil, silver foil, or the like, and is fixed to the surface of the dielectric board 106. The ground plate 4 includes an extending conductor 132 extending from the first side portion 12 toward the first linear element 24 of the first antenna 22. This extending conductor 132 is an example of the element facing unit 32, and makes up a facing portion 136 along with the element joint portion 34. The ground plate 4 includes an extending conductor 152 extending from the second side portion 14 toward the first linear element 44 of the second antenna 42. This extending conductor 152 is an example of the element facing unit 52, and makes up a facing portion 156 along with the element joint portion 54. The other configuration of the ground plate 4 is the same as with the ground plate 4 according to the first embodiment, and description thereof will be omitted.

The first antenna 22 is metal foil, for example, such as copper foil, aluminum foil, silver foil, or the like, and is fixed to the surface of the dielectric board 106. The first linear element 24 is disposed between the extending conductor 132 and the second linear element 26, and extends in the substantially vertical direction against the first side portion 12. The other configuration of the first antenna 22 is the same as with the first embodiment, and description thereof will be omitted.

The second antenna 42 is metal foil, for example, such as copper foil, aluminum foil, silver foil, or the like, and is fixed to the surface of the dielectric board 106. The first linear element 44 is disposed between the extending conductor 152 and the second linear element 46, and extends in the substantially vertical direction against the second side portion 14. The second linear element 46 includes a meandering portion 172 at the intermediate portion of the element. With respect to the meandering portion 172, the linear element 46 bends at an angle, and is meandering. Meandering of the element is not restricted to the intermediate portion, and may be at the edge portion or near the edge portion of the second linear element 46. When making the linear element meander, the way of the second linear element 46, i.e., distance along the linear element may be lengthened as compared to the straight-line distance of the second linear element 46. Specifically, with antennas which receive radio waves having the same frequency, an antenna of which the linear element has been subjected to meandering is shorter in straight-line distance than an antenna of which the linear element has not been subjected to meandering. The other configuration of the second antenna 42 is the same as with the first embodiment, and accordingly, description thereof will be omitted.

Figures 9A, 9B:
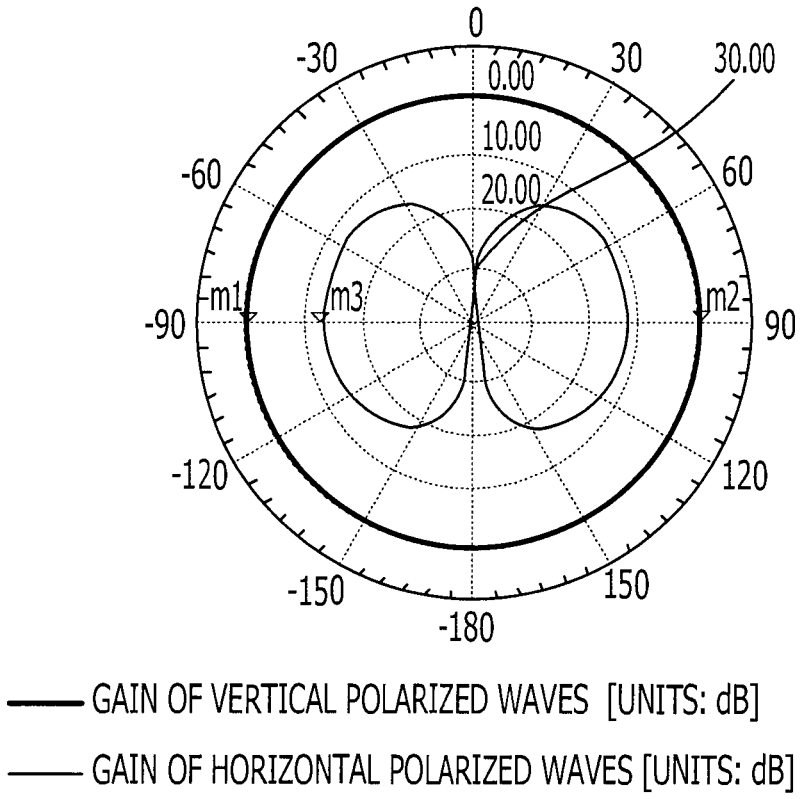
FIGS. 9A and 9B are diagrams illustrating an example of directivity in an X-Y plane at the time of feeding a first antenna.
Figures 10A, 10B:
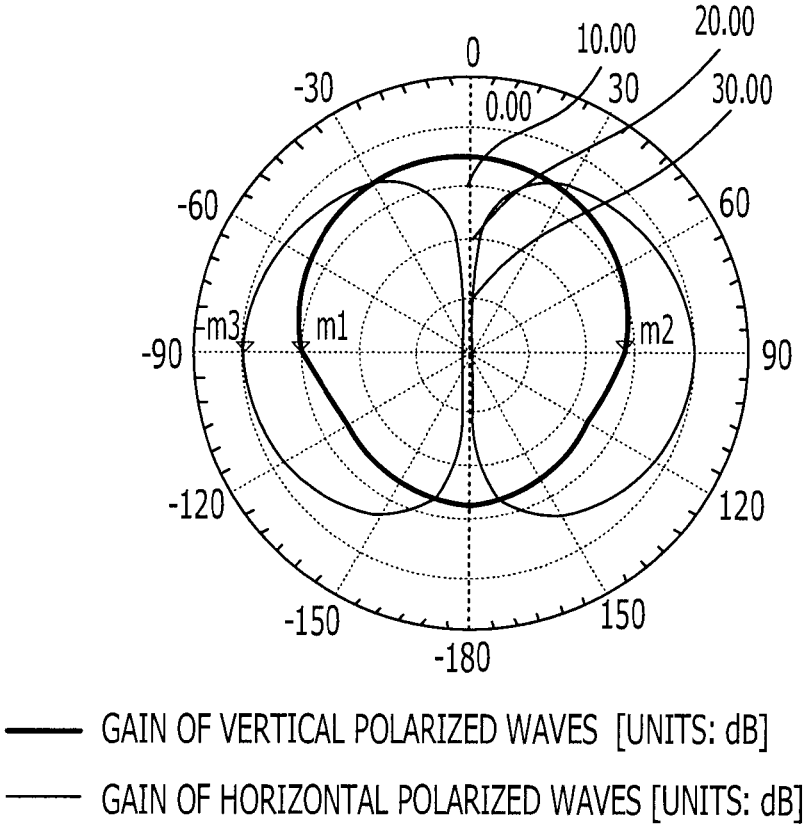
FIGS. 10A and 10B are diagrams illustrating an example of directivity in an X-Y plane at the time of feeding a second antenna.

Next, the directivity patterns and correlation coefficient of the antenna device 102 will be described with reference to FIGS. 9A, 9B, 10A, and 10B. FIGS. 9A and 9B are diagrams illustrating an example of directivity in the X-Y plane at the time of feeding the first antenna. FIGS. 10A and 10B are diagrams illustrating an example of directivity in the X-Y plane at the time of feeding the second antenna. Note that, with regard to the diagrams representing directivity, angle (Angle) 0 degree (upper direction in space) is ϕ (Phi)=0 degree, which indicates gain (Gain) in the positive direction of the X axis. Angle 90 degrees (right direction in space) is ϕ=90 degrees, which indicates gain in the positive direction of the Y axis. Angle −90 degrees (left direction in space) is ϕ=270 degrees, which indicates gain in the negative direction of the Y axis. Angle −180 degrees (lower direction in space) is ϕ=180 degrees, which indicates gain in the negative direction of the X axis. Note that the gain is represented with gain according to amplitude (Magnitude), and the units thereof are dB. Also, gain represented with a thick solid line represents gain of vertical polarized waves (Gain Theta), and again represented with a thin solid line represents gain of horizontal polarized waves (Gain Phi). Two marks m1 and m2 are added to gain of vertical polarized waves. The m1 is added in a direction where Phi is 270.0000 degrees, and Angle is −90.0000 degrees. The m2 is added in a direction where Phi is 90.0000 degrees, and Angle is 90.0000 degrees. One mark m3 is added to gain of horizontal polarized waves. The m3 is added in a direction where Phi is 270.0000 degrees, and Angle is −90.0000 degrees.

The directivity patterns illustrated in FIGS. 9A and 10A are results of analysis using simulation regarding the antenna device 102 illustrated in FIGS. 8A and 8B. At the time of analysis, an FR4 board was employed as the dielectric board 106. Example parameters of the antenna device 102 may be as follows.

Vertical Dimension of Ground Plate: GH: 70 mm
Horizontal Dimension of Ground Plate GW: 70 mm
Permittivity of Dielectric Board ∈r: 4.4
Dielectric Tangent of Dielectric Board tan δ: 0.02
Thickness of Dielectric Board h: 0.8 mm
Thickness of Inner Layer Metal Foil t: 0.035 mm
The analysis conditions are as follows.
Analysis Frequency: 1 GHz
Medium: Analysis assuming in vacuum In the directivity pattern illustrated in FIG. 9A, gain in vertical polarized waves is high as compared to horizontal polarized waves. For example, with the data illustrated in FIG. 9B, the magnitude of horizontal polarized waves at the mark m3 is −11.8576 dB. On the other hand, the magnitude of vertical polarized waves at the mark m1 is 1.1902 dB, and the magnitude of vertical polarized waves at the mark m2 is 1.2035 dB.

In the directivity pattern illustrated in FIG. 10A, gain in horizontal polarized waves is high as compared to vertical polarized waves. For example, with the data illustrated in FIG. 10B, the magnitude of vertical polarized waves at the mark m1 is −10.2973 dB, and the magnitude of vertical polarized waves at the mark m2 is −10.2851 dB. On the other hand, the magnitude of horizontal polarized waves at the mark m3 is 1.4102 dB.

The correlation coefficient of the antenna device 102 illustrated in FIGS. 8A and 8B was 0.16 according to calculation using the already-described Expression 1.

For comparison, the directivity patterns and correlation coefficient of an antenna device to which no slit is provided will be described with reference to FIGS. 11, 12A, 12B, 13A, and 13B.

Figure 11:
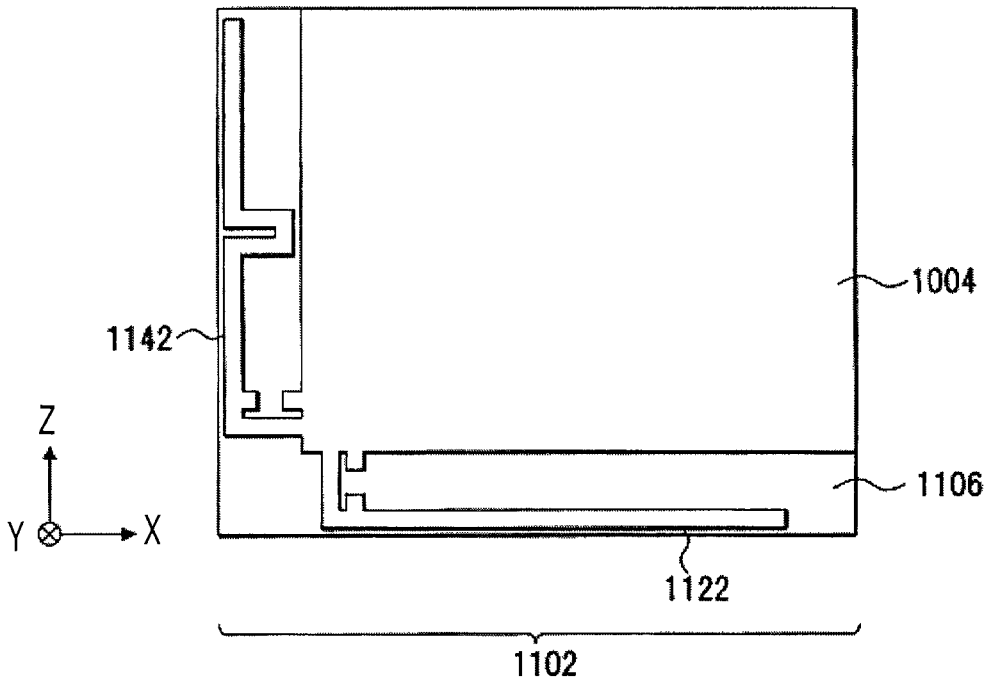
FIG. 11 is a diagram illustrating an example of an antenna device having no slit.

The directivity patterns illustrated in FIGS. 12A, 12B, 13A, and 13B are results of analysis using simulation regarding an antenna device 1102 illustrated in FIG. 11. The antenna device 1102 is the same as the antenna device 102 illustrated in FIGS. 8A and 8B except that no slit is disposed, and the lengths of antennas 1122 and 1142 have been adjusted, and accordingly, description thereof will be omitted.

Figures 12A, 12B:
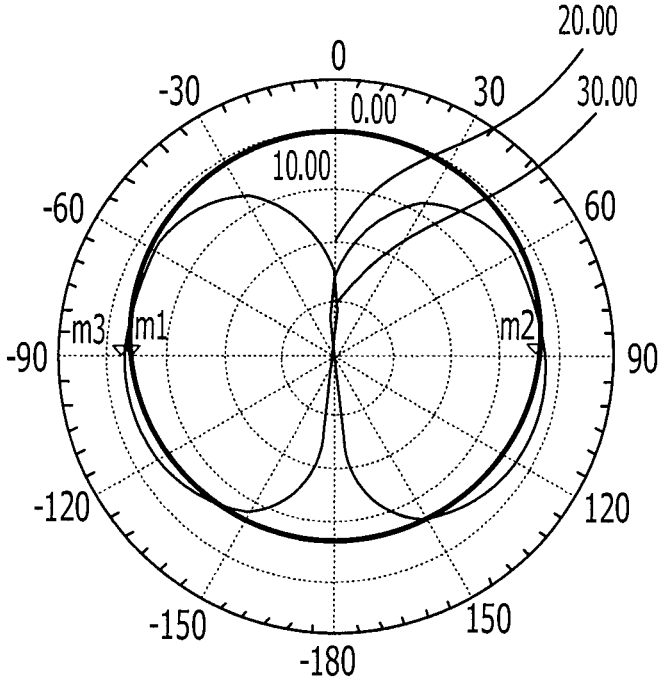
FIGS. 12A and 12B are diagrams illustrating an example of directivity in an X-Y plane at the time of feeding a first antenna.

With respect to the directivity pattern illustrated in FIG. 12A, as compared to a case where a slit is included, the difference between gain of horizontal polarized waves and gain of vertical polarized waves is reduced. For example, with the data illustrated in FIG. 12B, the magnitude of horizontal polarized waves at the mark m3 is −0.9905 dB. On the other hand, the magnitude of vertical polarized waves at the mark m1 is −2.7978 dB, and the magnitude of vertical polarized waves at the mark m2 is −2.7820 dB.

Figures 13A, 13B:
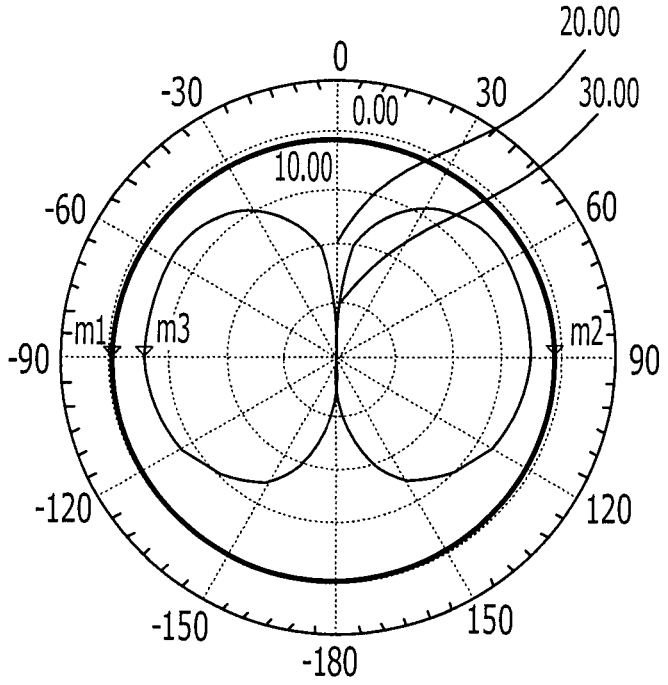
FIGS. 13A and 13B are diagrams illustrating an example of directivity in an X-Y plane at the time of feeding a second antenna.

With respect to the directivity pattern illustrated in FIG. 13A, as compared to a case where a slit is included, the difference between gain of horizontal polarized waves and gain of vertical polarized waves is reduced. For example, with the data illustrated in FIG. 13B, the magnitude of vertical polarized waves at the mark m1 is −0.2947 dB, and the magnitude of vertical polarized waves at the mark m2 is −0.2824 dB. On the other hand, the magnitude of horizontal polarized waves at the mark m3 is −4.7253 dB.

The correlation coefficient of the antenna device 1102 illustrated in FIG. 11 was 0.23 according to calculation using the already-described Expression 1.

According to the analysis results illustrated in FIGS. 9A, 9B, 10A, and 10B, in the event that a slit was provided, vertical polarized waves were strongly radiated from the first antenna 22, and horizontal polarized waves were strongly radiated from the second antenna 42. In comparison, according to the analysis results illustrated in FIGS. 12A, 12B, 13A, and 13B, in the event that no slit was provided, both of vertical polarized waves and horizontal polarized waves were strongly radiated from both of the first antenna 1122 and second antenna 1142. These analysis results indicate that in the event that no slit is provided, coupling between the antennas is strong. For example, this indicates that upon feeding the first antenna 1122, high-frequency current also flows into the second antenna 1142. These analysis results are caused by undesired polarized wave components being radiated from the second antenna 1142. Also, the correlation coefficient of the antenna device including no slit is higher than the correlation coefficient of the antenna device including the slit.

Specifically, with respect to the antenna device 102, in which the slit was provided to the ground plate 4, at the time of feeding the first antenna 22, vertical polarized waves became strong within the horizontal plane. At the time of feeding the second antenna 42, horizontal polarized waves became strong within the horizontal plane. Also, with the antenna device 102, the correlation coefficient deteriorated. The antenna device 102 including the slit was high in polarized wave diversity effects as compared to the antenna device 1102 including no slit.

Third Embodiment

Figure 14:
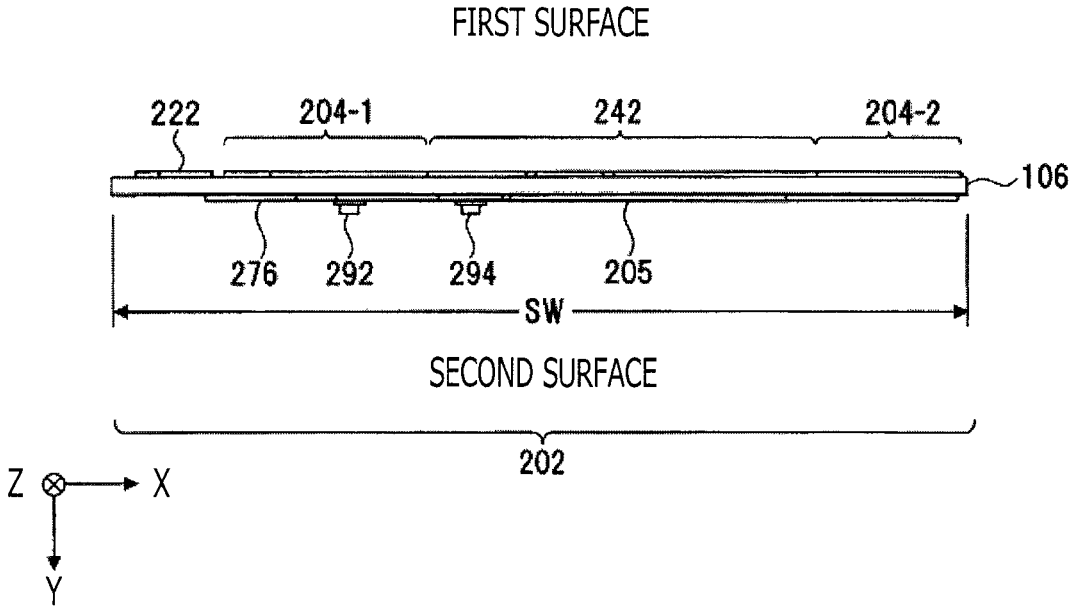
FIG. 14 is a bottom view illustrating an antenna device according to a third embodiment.
Figure 15:
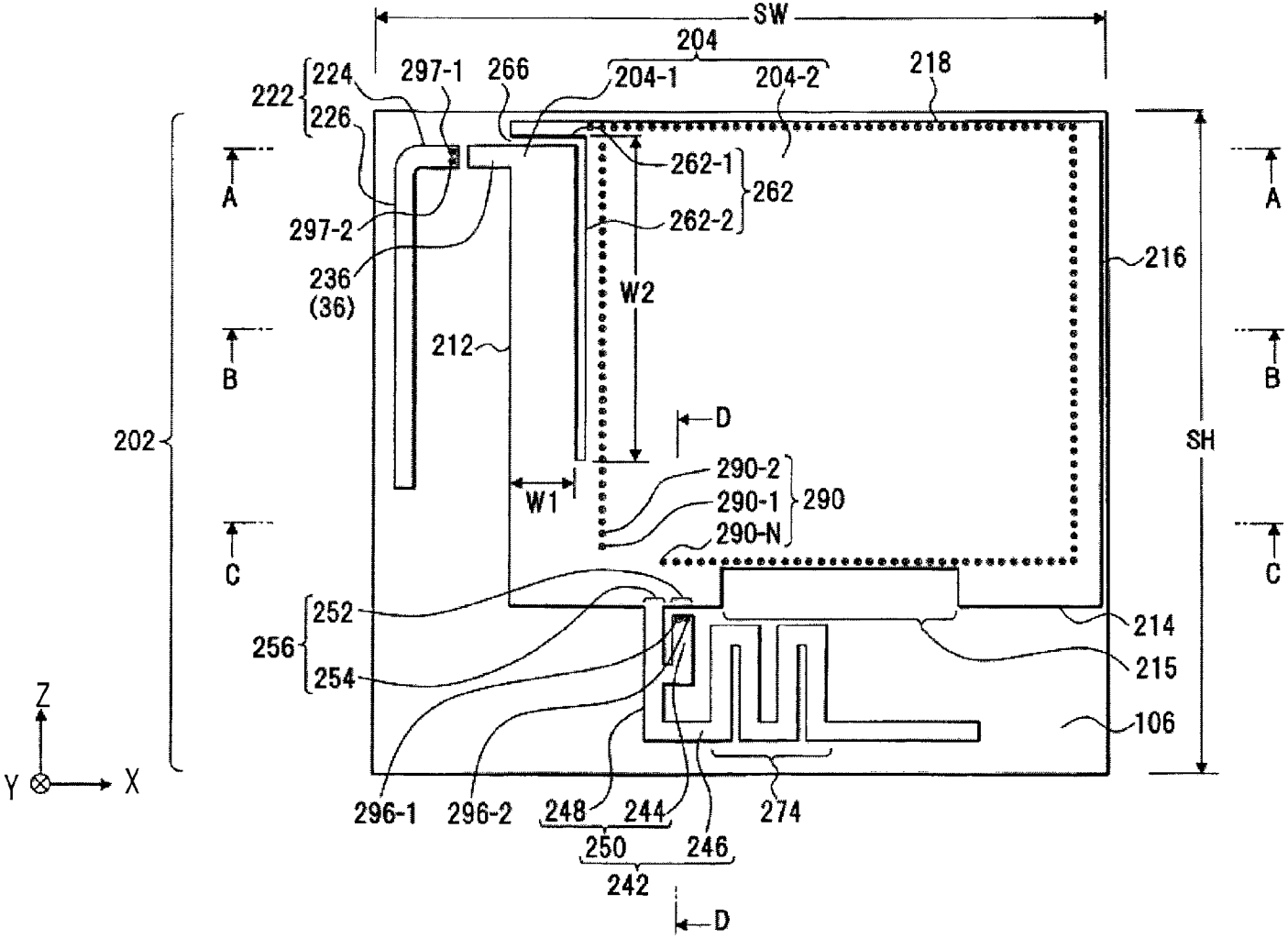
FIG. 15 is a front view illustrating an example of the antenna device.
Figure 16:
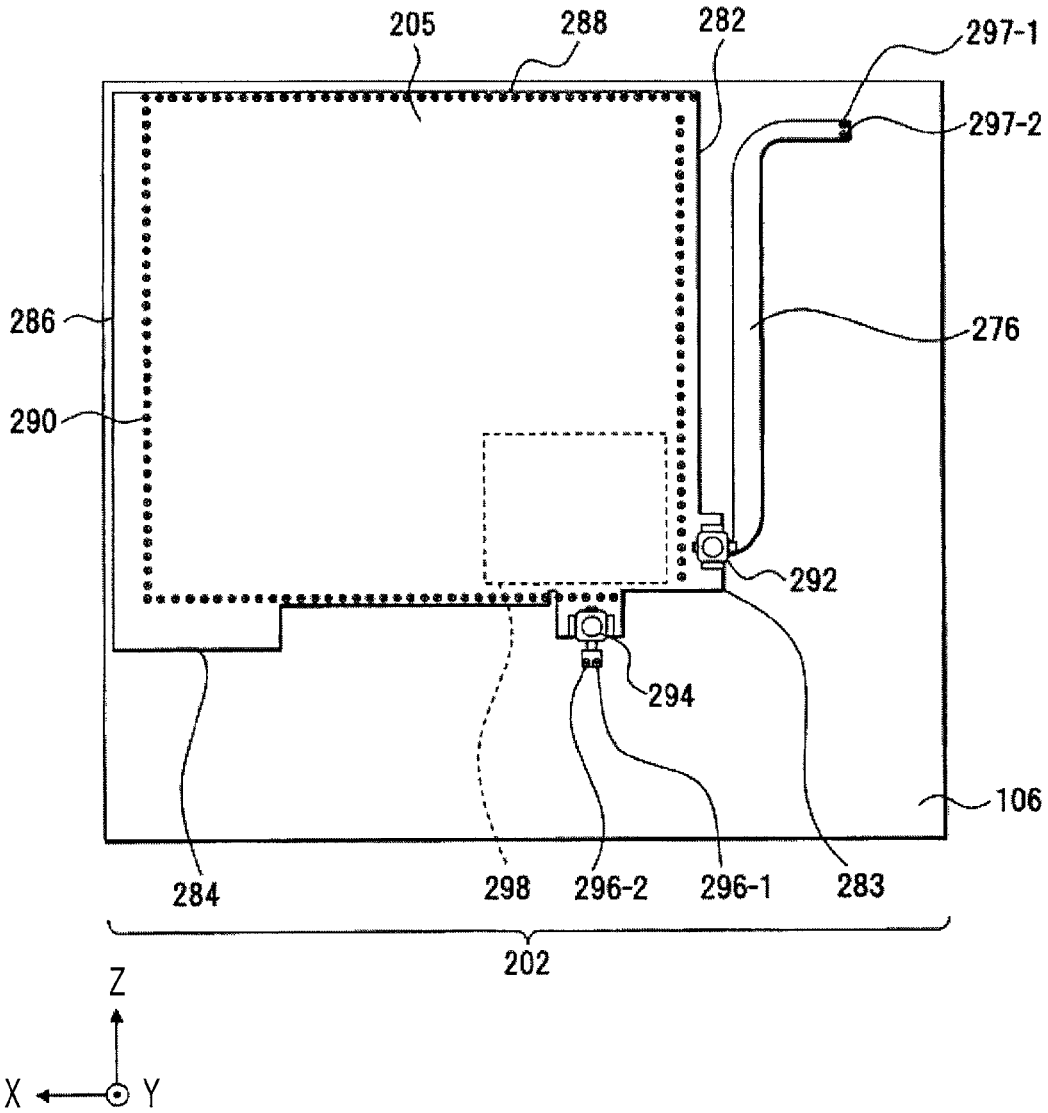
FIG. 16 is a back view illustrating an example of the antenna device.

A third embodiment will be described with reference to FIGS. 14 to 19. FIG. 14 is a bottom view of an antenna device according to the third embodiment. FIG. 15 is a front view of the antenna device. FIG. 16 is a back view of the antenna device. Note that, in FIG. 14, the horizontal direction in space is taken as the X axis, the lengthwise direction in space is taken as the Y axis, and the vertical direction in space is taken as the Z axis. In FIGS. 15 and 16, the horizontal direction in space is taken as the X axis, the vertical direction in space is taken as the Y axis, and the lengthwise direction in space is taken as the Z axis.

With respect to the first and second embodiments, the first antenna 22 and second antenna 42 include short-circuit elements 28 and 48 respectively as an example of ground terminals, but the ground terminals are not restricted to the short-circuit elements 28 and 48. For example, with the third embodiment, a first antenna 222 includes a first linear element 224 and a second linear element 226, and a ground plate 204 includes an extending conductor 236 extending toward the first linear element 224 of the first antenna 222. With respect to the present third embodiment, the second linear element 226 serves as a radiating element, and the first linear element 224 or extending conductor 236 or both thereof serve as ground terminals, for example.

The antenna device 202 illustrated in FIG. 14 is a diagram viewing the positive direction of the Z axis from the negative direction of the Z axis. The antenna device 202 includes a dielectric board 106 where the vertical dimension is SH, and the horizontal dimension is SW. The dielectric board is the same as with the second embodiment, and accordingly, the description thereof will be omitted. The first antenna 222, second antenna 242, and first ground plate 204 are disposed on a first surface of the dielectric board 106, e.g., the surface on the front face side. A second ground plate 205 is disposed on the other surface of the dielectric board 106, e.g., the surface on the rear face side. With respect to this other surface, a strip conductor 276, connection connectors 292 and 294 are disposed.

The first surface of the dielectric board 106 will be described with reference to FIG. 15. The ground plate 204, first antenna 222, and second antenna 242 are configured of metal foil, for example, such as copper foil, aluminum foil, silver foil, or the like, and fixed to the surface of the dielectric board 106. The ground plate 204 is, for example, a flat plate, and has a substantially rectangular shape. The ground plate 204 has a first side portion 212, a second side portion 214, a third side portion 216, and a fourth side portion 218. The first side portion 212 faces the third side portion 216, and is adjacent to the second side portion 214 and fourth side portion 218. The second side portion 214 includes a retracted portion 215 at an intermediate portion.

The first antenna 222 is disposed in the first side portion 212. The second antenna 242 is disposed in the second side portion 214. The first linear element 224 is disposed in a position in the vicinity of the first side portion 212 closer to the fourth side portion 218 as the base of the first antenna 222. A base 250 of the second antenna 242 is provided to the second side portion 214 and is disposed in a position closer to the second side portion 212. The ground plate 204 includes an extending conductor 236 extending toward the first linear element 224 of the first antenna 222 from the first side portion 212. This extending conductor 236 is an example of the facing portion 36. Note that, with respect to the first and second embodiments, the first side portion 12 is set to be in parallel with the X axis, and the first antenna 22 is disposed in this side portion. The second side portion 14 is set to be in parallel with the Z axis, and the second antenna 42 is disposed in this side portion. With respect to the present embodiment, the first side portion 212 is set to be in parallel with the Z axis, and the first antenna 222 is disposed in this side portion. The second side portion 214 is set to be in parallel with the X axis, and the second antenna 242 is disposed in this side portion.

A slit 262 is formed in the first ground plate 204. The slit 262 forms an elongated notch for the ground plate 204, and forms a non-electro-conductive portion. The slit 262 forms an opening 266 in the first side portion 212 in an adjacent portion adjacent to the extending conductor 236. For example, the slit 262 forms an opening 266 in a joint portion where the ground terminal of the first antenna 222 is joined to the ground plate 204. This opening 266 is formed on the fourth side portion 218 side closer to the extending conductor 236, for example. The slit 262 extends to the inner side, i.e., inward of the ground plate 204 from the opening 266 to form a slit 262-1. This slit 262-1 extends in a substantially parallel direction against the first linear element 224. The slit 262 substantially orthogonally bends at a position of length W1 mm from the first side portion 212. The slit 262 extends in the substantially parallel direction against the first side portion 212 after bending to form a slit 262-2. Namely, the slit 262-2 extends along the first side portion 212 where the first antenna 222 is disposed. The slit 262-2 has length W2 mm. A ground plate 204-1 around the first side portion 212 is surrounded in two directions by the slit 262, and is separated from another ground plate 204-2.

The circumference of the extending conductor 236 is surrounded by the slit 262. Therefore, the extending conductor 236 and facing portion 256 are connected via the ground plate 204-1 where the length in the width direction is restricted to the W1. According to such connection, coupling between the first antenna 222 and the second antenna 242 is suppressed. In the event of having powered the first antenna 222 or second antenna 242, high-frequency current on the powered side is suppressed from flowing into the other antenna.

Multiple through holes are formed in the circumference of the ground plate 204. The through holes reach the second ground plate 205 illustrated in FIG. 14. With respect to the inner surfaces of the through holes, a metal film, such as a copper film, an aluminum film, a silver film, or the like is formed. According to the through holes and metal film, via holes 290-1, 290-2, . . . , 290-N, i.e., via holes 290 are formed. The via holes 290 electrically connect the ground plate 204-2 and the second ground plate 205 by the metal film.

The first antenna 222 includes the first linear element 224 and second linear element 226. The first linear element 224 makes up the base of the first antenna 222.

The first linear element 224 is disposed between the extending conductor 236 and the second linear element 226, and extends in the substantially vertical direction against the first side portion 212. The first linear element 224 is disposed adjacent to the extending conductor 236. The first linear element 224 makes up a feeding portion of the first antenna 222. A power feeder is connected to the first linear element 224. The first linear element 224 is connected to the second linear element 226.

The second linear element 226 serves as a radiating element of the first antenna 222. The second linear element 226 extends in the substantially parallel direction against the first side portion 212. The second linear element 226 is connected to the first linear element 224 at one edge portion thereof.

The first antenna 222 forms an inverted-L antenna using the first linear element 224 and second linear element 226. Connecting transmission lines to an edge portion on the extending conductor 236 side of the first linear element 224 enables the first antenna 222 to transmit/receive radio waves.

The second antenna 242 includes a first linear element 244, a second linear element 246, and a short-circuit element 248. The first linear element 244 and short-circuit element 248 makes up a base 250 of the second antenna 242.

The first linear element 244 is disposed between the second side portion 214 and the second linear element 246, and extends in the substantially vertical direction against the second side portion 214. The first linear element 244 is disposed adjacent to an element facing portion 252. The first linear element 244 makes up a feeding portion of the second antenna 242. A power feeder is connected to the first linear element 244. The first linear element 244 bends toward the short-circuit element 248, and is connected to the short-circuit element 248.

The second linear element 246 serves as a radiating element of the second antenna 242. The second linear element 246 extends in the substantially parallel direction against the second side portion 214. The second linear element 246 includes a meandering portion 274 at the intermediate portion of the element. With respect to the meandering portion 274, the linear element 246 bends at an angle, and is meandering. Meandering of the element is not restricted to the intermediate portion, and may be at the edge portion or near the edge portion of the second linear element 246. The second linear element 246 is connected to the short-circuit element 248 at one edge portion.

The short-circuit element 248 is an example of the ground terminal of the second antenna 242, disposed between the second side portion 214 and the second linear element 246, and disposed in the vicinity of the first linear element 244. The short-circuit element 248 extends in the substantially vertical direction against the second side portion 214. The short-circuit element 248 is connected to the second linear element 246 and an element joint portion 254 of the ground plate 204, and connects the second linear element 246 and ground plate 204. The short-circuit element 248 shorts the second antenna 242 to the ground plate 204. The second antenna 242 forms an inverted-F antenna using the first linear element 244, second linear element 246, and short-circuit element 248. Note that, with the ground plate 204, the facing portion 256 facing the base 250 of the antenna 242 is formed by the element facing portion 252 and element joint portion 254.

Figure 17A:
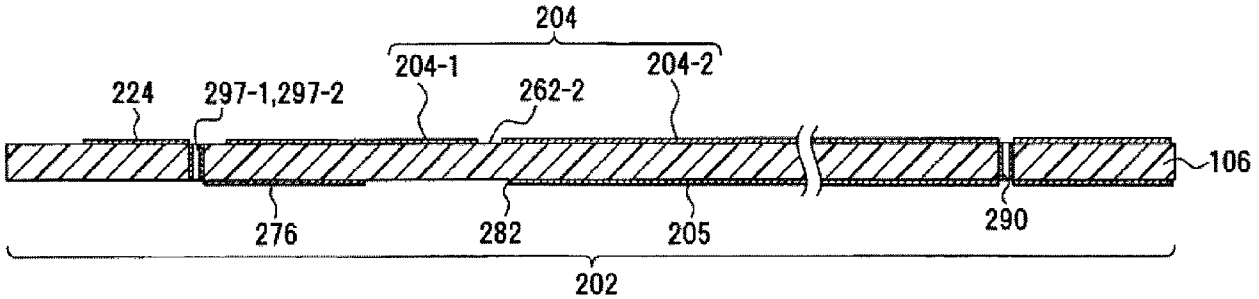
FIGS. 17A to 17C are end views illustrating an example of the antenna device.
Figure 17B:
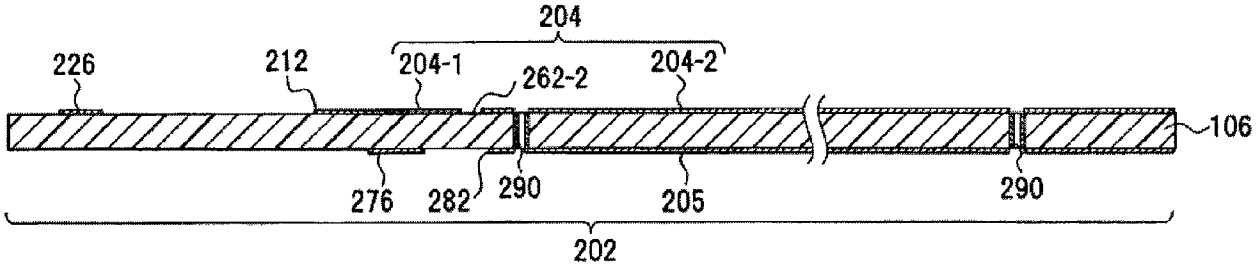

The second surface of the dielectric board 106 will be described with reference to FIG. 16. The second ground plate 205 and strip conductor 276 are disposed on the second surface of the dielectric board 106. The second ground plate 205 includes a first side portion 282, a second side portion 284, a third side portion 286, and a fourth side portion 288. The first side portion 282 is formed on the further inward side of the dielectric board 106 than the first side portion 212 (FIG. 17B). The second side portion 284, third side portion 286, and fourth side portion 288 are formed in positions corresponding to the second side portion 214, third side portion 216, and fourth side portion 218. The via holes 290 are formed around the second ground plate 205.

The connection connectors 292 and 294 are connection connectors for connecting to transmission lines such as a coaxial cable or the like, and are disposed in the vicinity of a corner portion 283 where the first side portion 282 and second side portion 284 intersect. An RF (Radio Frequency) circuit is, for example, disposed in a neighboring area 298 of the connection connectors 292 and 294. The RF circuit is disposed in the vicinity of the connection connectors 292 and 294, whereby transmission lines which connect the RF circuit and connection connectors 292 and 294 may be shortened. The transmission lines are shortened, whereby influence to antenna properties according to change in the position of the transmission lines may be suppressed.

Figure 17C:
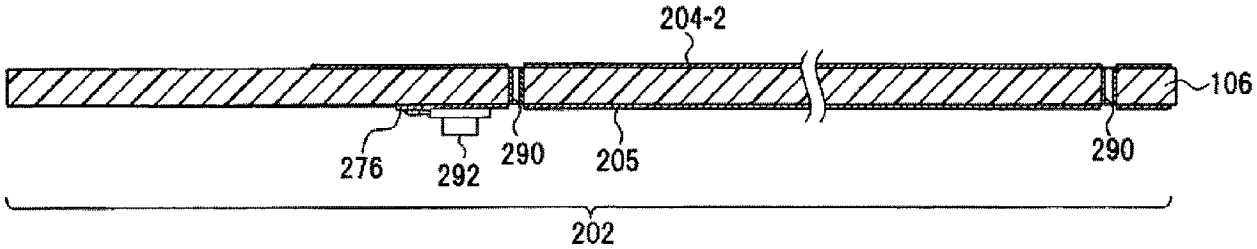

Next, power supply to the first antenna will be described with reference to FIGS. 17A to 17C. FIG. 17A is a diagram illustrating an example of an A-A line edge face of the antenna device illustrated in FIG. 15. FIG. 17B is a diagram illustrating an example of a B-B line edge face of the antenna device illustrated in FIG. 15. FIG. 17C is a diagram illustrating an example of a C-C line edge face of the antenna device illustrated in FIG. 15.

The ground plate 204-1 is disposed on the first surface of the dielectric board 106 illustrated in FIG. 15. By comparison, with respect to the second surface of the dielectric board 106 illustrated in FIG. 16, the strip conductor 276 is disposed in a position facing the ground plate 204-1. With respect to the second surface of the dielectric board 106, a microstrip line is formed by making the strip conductor 276 face the ground plate 204-1 via the dielectric board 106. The microstrip line makes up a power feeder and serves as transmission lines.

With respect to the edge face illustrated in FIG. 17A, the tip portion of the strip conductor 276 is overlaid on the edge portion of the first linear element 224 via the dielectric board 106. Via holes 297-1 and 297-2 are formed between the tip portion of the strip conductor 276 and the edge portion of the first linear element 224. According to the via holes 297-1 and 297-2, the first linear element 224 is connected to the strip conductor 276. The ground plate 204-1 servers as a ground plate of the first antenna 222, and also serves as a ground conductor of the microstrip line.

With respect to the edge face illustrated in FIG. 17B, the intermediate portion of the microstrip line is illustrated. The microstrip line is formed by making the strip conductor 276 face the ground plate 204-1 via the dielectric board 106.

With respect to the edge face illustrated in FIG. 17C, the connection connector 292 is disposed. The strip conductor 276 is connected to this connection connector. Also, the ground plate 204 is connected to the ground plate 205 via the via holes 290, and this ground plate 205 is connected to the connection connector 292. In the event of connecting transmission lines such as a coaxial cable or the like to the connection connector 292, power supply to the first antenna 222 is enabled.

Figure 18:
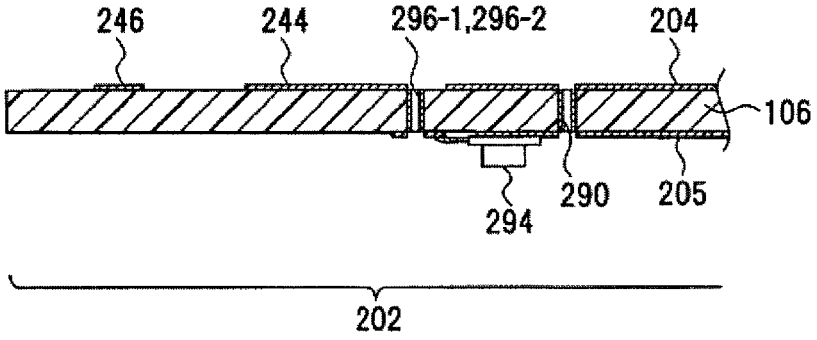
FIG. 18 is an end view illustrating an example of the antenna device.

Next, power supply to the second antenna will be described with reference to FIG. 18. FIG. 18 is a diagram illustrating an example of a D-D line edge face of the antenna device illustrated in FIG. 15.

The connection connector 294 is disposed on the edge face illustrated in FIG. 18. This connection connector 294 is disposed in a position facing the edge portion or near the edge portion of the first linear element 244. The connection connector 294 is connected to the edge portion of the first linear element 244 via the via holes 296-1 and 296-2. According to connection of transmission lines, one line of the transmission lines, e.g., the inner conductor of a coaxial cable is connected to the edge portion of the first linear element 244. The connection connector 294 is connected to the second ground plate 205. According to connection of the transmission lines, the other line of the transmission lines, e.g., the external conductor of the coaxial cable is connected to the ground plates 204 and 205.

Figure 19:
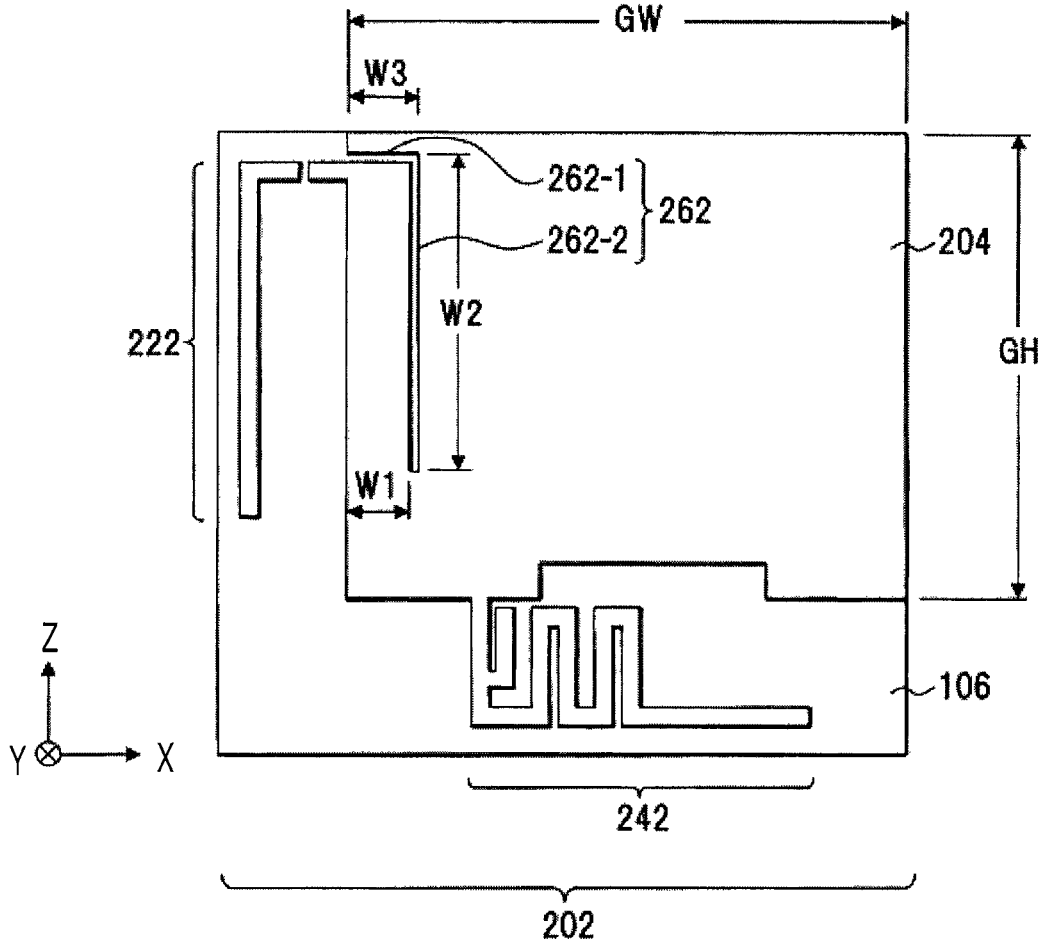
FIG. 19 is a diagram illustrating an example of the antenna device.
Figures 20A, 20B:
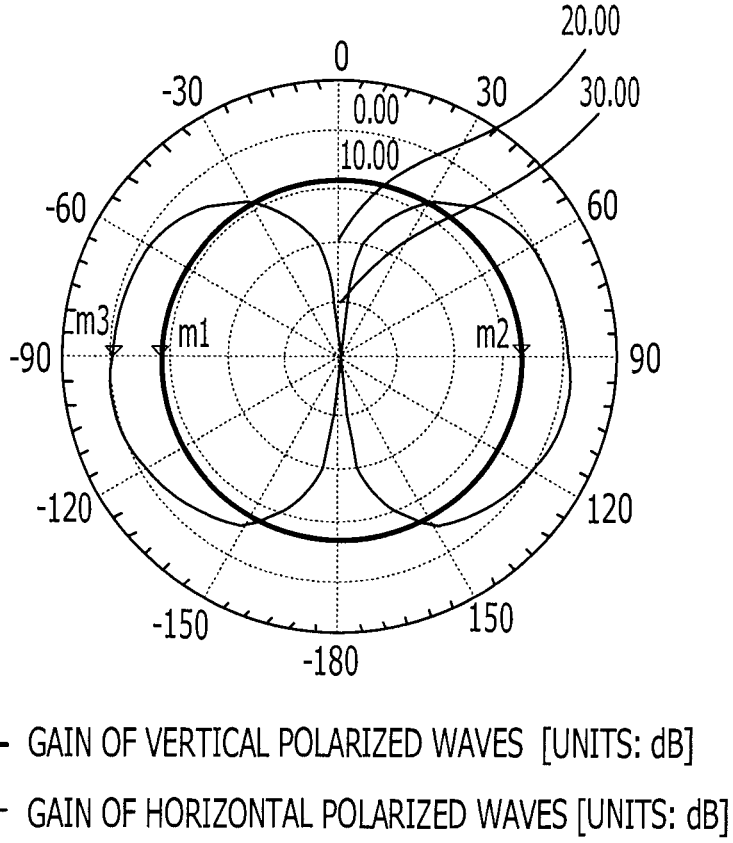
FIGS. 20A and 20B are diagrams illustrating an example of directivity in an X-Y plane at the time of feeding a first antenna.
Figures 21A, 21B:
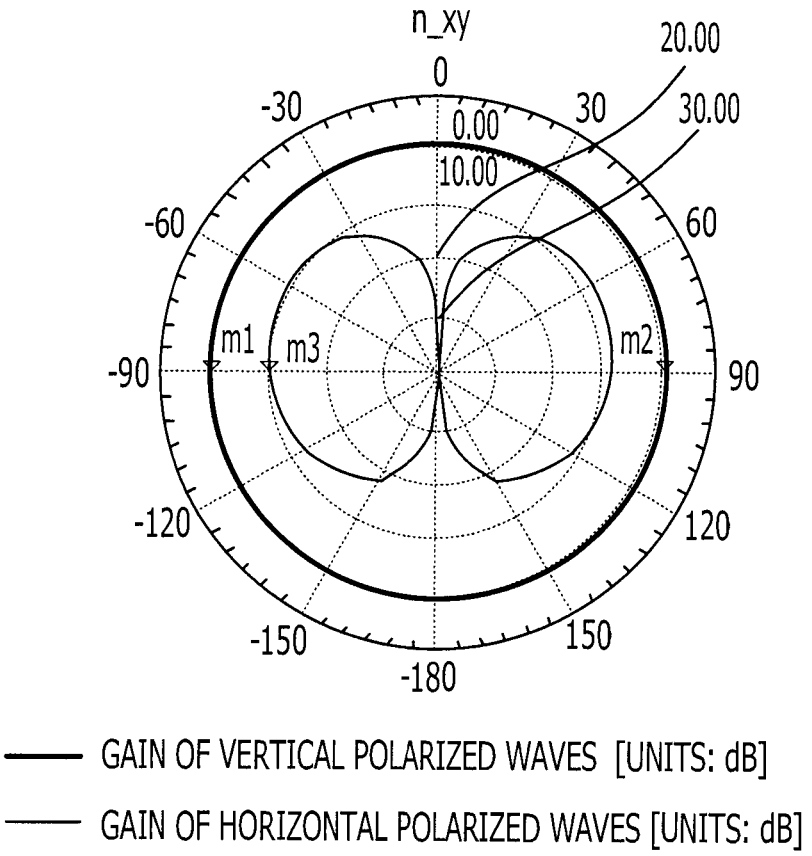
FIGS. 21A and 21B are diagrams illustrating an example of directivity in an X-Y plane at the time of feeding a second antenna.

Next, the directivity and correlation coefficient of an antenna device will be described with reference to FIGS. 19, 20A, 20B, 21A, and 21B. FIG. 19 is a diagram illustrating an example of an antenna device. FIGS. 20A and 20B are diagrams illustrating an example of directivity in an X-Y plane at the time of feeding the first antenna 222. FIGS. 21A and 21B are diagrams illustrating an example of directivity in the X-Y plane at the time of feeding the second antenna 242.

Next, the directivity patterns illustrated in FIGS. 20A to 21B are analysis results using simulation regarding the antenna device 202 illustrated in FIG. 19. The antenna device 202 illustrated in FIG. 19 is an antenna device modeled after the antenna device 202 illustrated in FIG. 15. At the time of analysis, an FR4 board was employed as the dielectric board 106. The parameters are as follows.

Vertical Dimension of Ground Plate: GH: 52 mm

Horizontal Dimension of Ground Plate GW: 63 mm

Permittivity of Dielectric Board ∈r: 4.4

Dielectric Tangent of Dielectric Board tan δ: 0.02

Thickness of Dielectric Board h: 0.8 mm

Thickness of Inner Layer Metal Foil t: 0.035 mm

Distance between Slit 262-2 and First Side Portion 212 W1: 7 mm

Length of Slit 262-2 W2: 35.5 mm

Length of Slit 262-1 W3: 8 mm

Width of Slit: 1 mm

The analysis conditions are the following value.

Analysis Frequency: 1 GHz

In the directivity pattern illustrated in FIG. 20A, gain in horizontal polarized waves is high as compared to vertical polarized waves. For example, with the data illustrated in FIG. 20B, the magnitude of vertical polarized waves at the mark m1 is −7.2630 dB, and the magnitude of vertical polarized waves at the mark m2 is −7.3060 dB. On the other hand, the magnitude of horizontal polarized waves at the mark m3 is 0.9841 dB.

In the directivity pattern illustrated in FIG. 21A, gain in vertical polarized waves is high as compared to horizontal polarized waves. For example, with the data illustrated in FIG. 21B, the magnitude of horizontal polarized waves at the mark m3 is −9.2515 dB. On the other hand, the magnitude of vertical polarized waves at the mark m1 is 1.0185 dB, and the magnitude of vertical polarized waves at the mark m2 is 1.0849 dB.

The correlation coefficient of the antenna device 202 illustrated in FIG. 19 was 0.01 according to calculation using the already-described Expression 1.

For comparison, the directivity patterns and correlation coefficient of an antenna device 1202 to which no slit is provided will be described with reference to FIGS. 22, 23A, 23B, 24A, and 24B.

Figure 22:
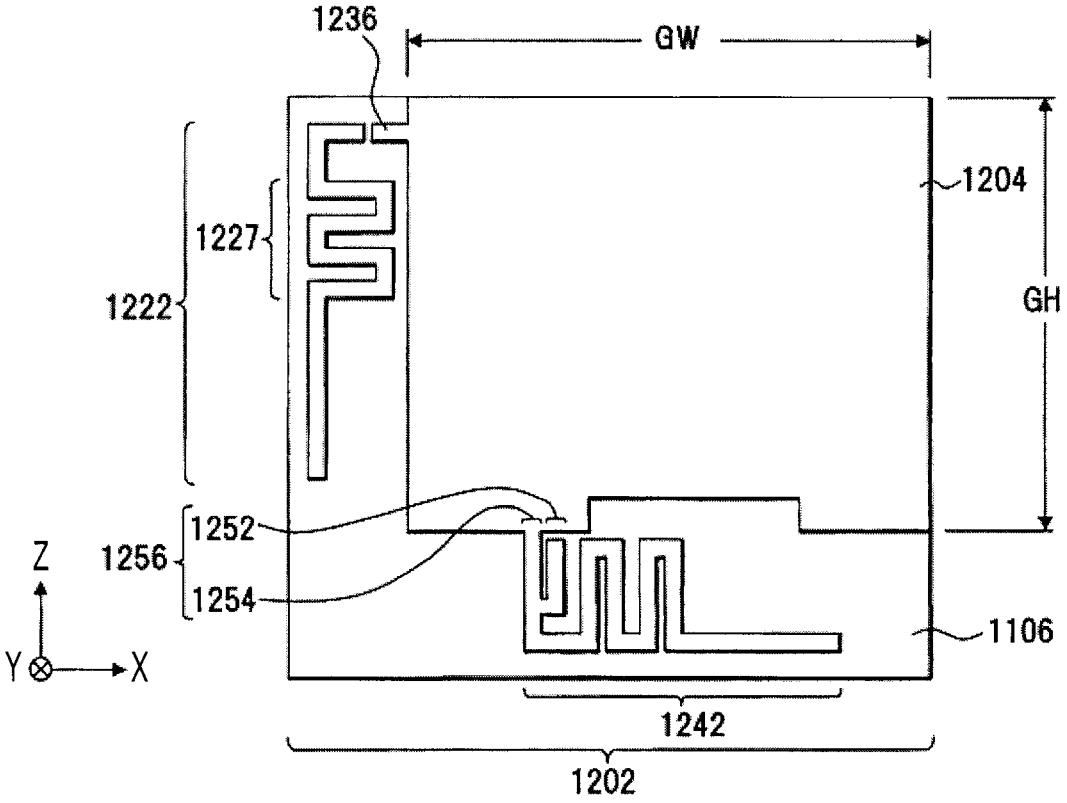
FIG. 22 is a diagram illustrating an example of an antenna device having no slit.
Figures 23A, 23B:
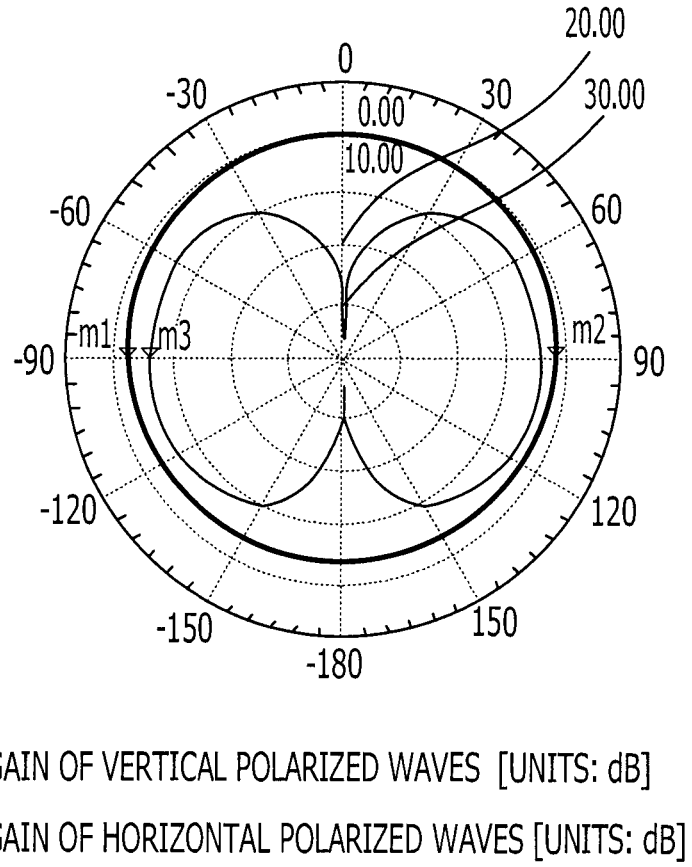
FIGS. 23A and 23B are diagrams illustrating an example of directivity in an X-Y plane at the time of feeding a first antenna.
Figures 24A, 24B:
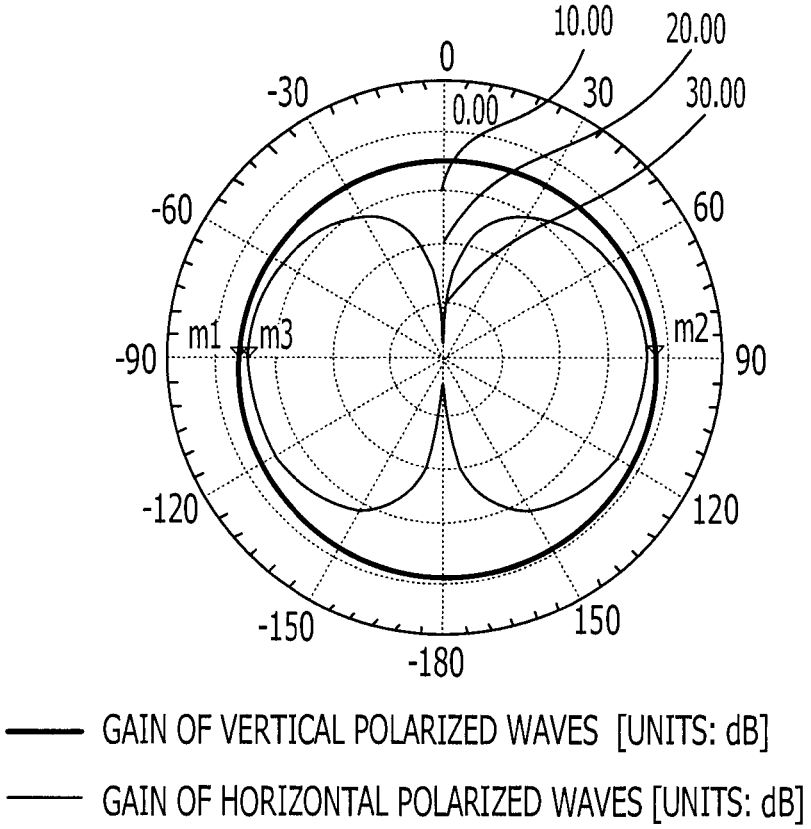
FIGS. 24A and 24B are diagrams illustrating an example of directivity in an X-Y plane at the time of feeding a second antenna.

The directivity patterns illustrated in FIGS. 23A and 24A are results of analysis using simulation regarding an antenna device 1202 illustrated in FIG. 22. The antenna device 1202 is the same as the antenna device 202 illustrated in FIG. 19 except that no slit is provided, and a meandering portion 1227 is disposed in a first antenna device 1222 for adjustment of antenna length.

In the directivity pattern illustrated in FIG. 23A, as compared to a case where a slit is included, difference between gain of horizontal polarized waves and gain of vertical polarized waves is reduced. For example, with the data illustrated in FIG. 23B, the magnitude of vertical polarized waves at the mark m1 is −0.8145 dB, and the magnitude of vertical polarized waves at the mark m2 is −0.6445 dB. On the other hand, the magnitude of horizontal polarized waves at the mark m3 is −3.2571 dB.

In the directivity pattern illustrated in FIG. 24A, as compared to a case where a slit is included, the difference between gain of horizontal polarized waves and gain of vertical polarized waves is reduced. For example, with the data illustrated in FIG. 24B, the magnitude of horizontal polarized waves at the mark m3 is −2.9788 dB. On the other hand, the magnitude of vertical polarized waves at the mark m1 is −2.0906 dB, and the magnitude of vertical polarized waves at the mark m2 is −2.2728 dB.

The correlation coefficient of the antenna device 1202 illustrated in FIG. 22 was 0.45 according to calculation using the already-described Expression 1.

According to the analysis results illustrated in FIGS. 20A, 20B, 21A, and 21B, in the event that a slit was provided, horizontal polarized waves were strongly radiated from the first antenna 222, and vertical polarized waves were strongly radiated from the second antenna 242. On the other hand, according to the analysis results illustrated in FIGS. 23A, 23B, 24A, and 24B, in the event that no slit was provided, both of vertical polarized waves and horizontal polarized waves were strongly radiated from both of the first antenna 1222 and second antenna 1242. With respect to the antenna device 1202, though between an extending conductor 1236 and a facing portion 1256 was separated, coupling between the antennas was high. This may be conceived that the tip portion of the first antenna 1222 extended on the second antenna 1242 side, and this tip portion caused electromagnetic coupling with the ground plate 1204, and consequently, the antennas were coupled. Namely, the antennas were coupled in a place where the position of the ground plate facing the tip portion of the second antenna 1242 came closer to the facing portion 1256. Even when such coupling is caused, the slit 262 as illustrated in FIG. 19 is provided, whereby the correlation coefficient may be lowered even when feeding either of the first antenna 222 and second antenna 242.

Specifically, with the antenna device 202 in which the slit was provided to the ground plate 204, at the time of feeding the first antenna 222, horizontal polarized waves became strong within the horizontal plane. At the time of feeding the second antenna 242, vertical polarized waves became strong within the horizontal plane. Also, with the antenna device 202, the correlation coefficient deteriorated. The antenna device 202 including the slit was high in polarized wave diversity effects as compared to the antenna device 1202 including no slit.

As described above, with the antenna device 202, the first antenna is an inverted-L antenna, for example. The slit 62 includes the slit 62-1 which extends from a joint portion where the root portion of this inverted-L antenna, e.g., the ground terminal of the antenna is joined to the ground plate 204 toward a direction parallel to the ground terminal of the antenna thereof. In this way, there may be provided a polarized wave diversity antenna wherein even when providing the slit, coupling between the antennas may be suppressed, and the correlation coefficient is low though the size is small.

Fourth Embodiment

Figure 25:
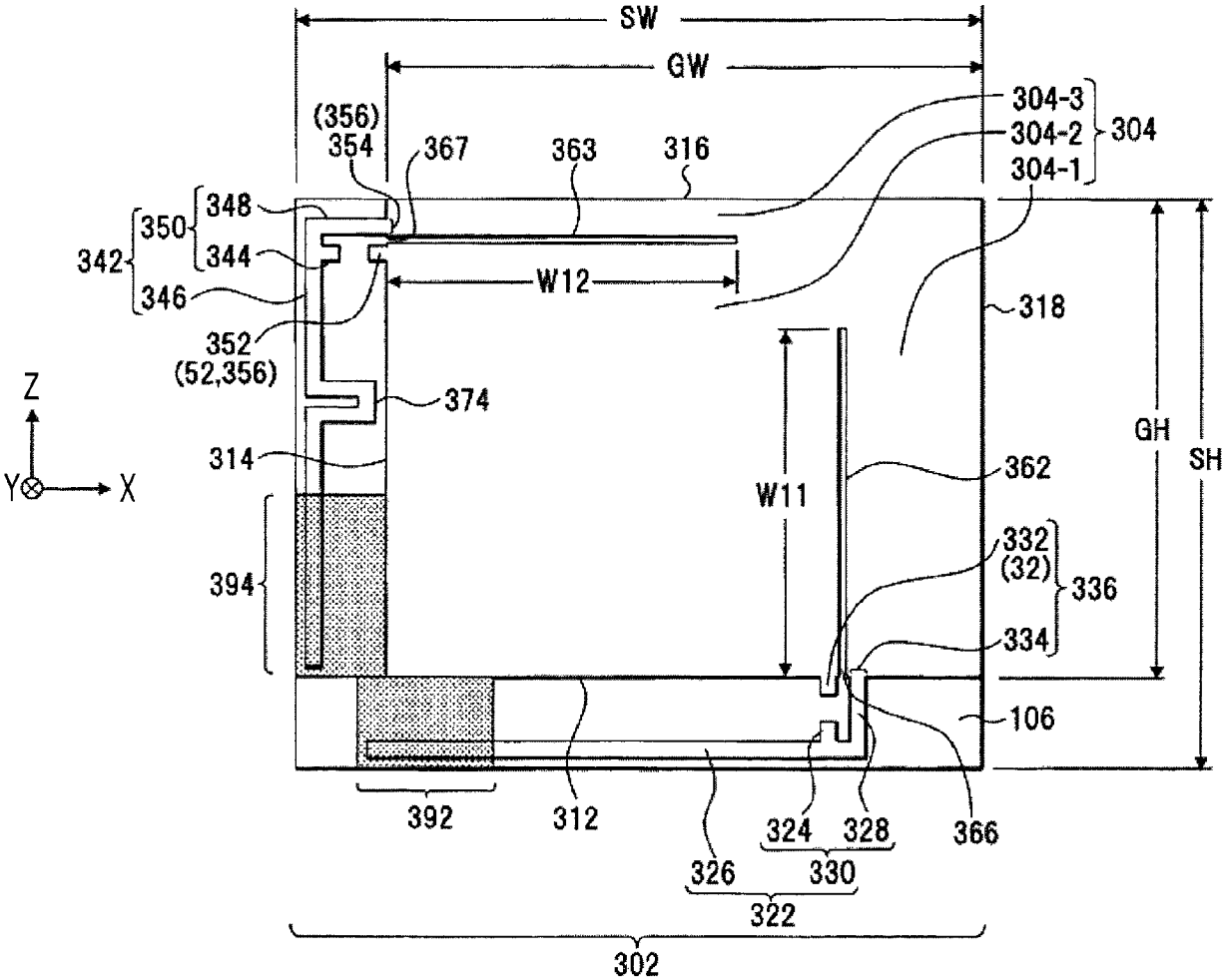
FIG. 25 is a diagram illustrating an antenna device according to a fourth embodiment.

A fourth embodiment will be described with reference to FIG. 25. FIG. 25 is a diagram illustrating an example of an antenna device according to the fourth embodiment. Note that, in FIG. 25, the horizontal direction in space is taken as the X axis, the vertical direction in space is taken as the Y axis, and the lengthwise direction in space is taken as the Z axis. In the fourth embodiment, a slit 362 extends from the tip side of a slit 363 toward a direction parallel to a radiating element of a second antenna 342. Also, the slit 363 extends from the tip side of the slit 362 toward a direction parallel to a radiating element of a first antenna 322.

An antenna device 302 illustrated in FIG. 25 includes a dielectric board 106 where the vertical dimension is SH, and the horizontal dimension is SW. The dielectric board is the same as with the second embodiment, and accordingly, description thereof will be omitted. The first antenna 322, second antenna 342, and a ground plate 304 are disposed on the dielectric board 106. The antennas 322 and 342 and ground plate 304 are metal foil, for example, such as copper foil, aluminum foil, silver foil, or the like, and are fixed to the surface of the dielectric board 106.

The ground plate 304 includes a first side portion 312, a second side portion 314, a third side portion 316, and a fourth side portion 318. The first side portion 312 and second side portion 314 are adjacent, and substantially orthogonal.

The first antenna 322 is disposed in the first side portion 312, and the second antenna 342 is disposed in the second side portion 314. A base 330 of the first antenna 322 is disposed in a position in the vicinity of the first side portion 312 closer to the fourth side portion 318. A base 350 of the second antenna 342 is disposed in a position in the vicinity of the second side portion 314 closer to the third side portion 316.

The ground plate 304 includes an extending conductor 332 extending toward a first linear element 324 of the first antenna 322 from the first side portion 312. This extending conductor 332 is an example of the element facing portion 32. The ground plate 304 includes an extending conductor 352 extending toward the first linear element 344 of the second antenna 342 from the second side portion 314. This extending conductor 352 is an example of the element facing portion 52.

With respect to the ground plate 304, two slits 362 and 363 are formed. The slits 362 and 363 form an elongated notch for the ground plate 304, and form a non-electro-conductive portion.

The slit 362 forms an opening 366 in the first side portion 312 in an adjacent portion adjacent to the extending conductor 332 and element joint portion 334. For example, the slit 362 forms an opening 366 in a joint portion where the ground terminal of the first antenna 322 is joined to the ground plate 304. The slit 362 linearly extends to the inner side, i.e., inward of the ground plate 304 from the opening 366. The slit 362 extends substantially vertically against the first side portion 312. Namely, the slit 362 extends in the substantially parallel direction against the fourth side portion 318 adjacent to the first side portion 312 along the fourth side portion 318. Length W11 of the slit 362 is 39 mm, for example. In the event of representing the length W11 (39 mm) by normalized wavelength with the frequency as 1 GHz, this becomes 0.13 wavelength (0.13λ).

A ground plate 304-1 is surrounded by the slit 362, first side portion 312, and fourth side portion 318 in three directions, and is separated from a ground plate 304-2. Therefore, the ground plate 304-1 is connected to the ground plate 304-2 bypassing the slit 362. Namely, the element joint portion 334 is surrounded by the slit 362.

The slit 363 forms an opening 367 in the second side portion 314 in an adjacent portion adjacent to the extending conductor 352 and element joint portion 354. For example, the slit 363 forms an opening 367 in a joint portion where the ground terminal of the second antenna 342 is joined to the ground plate 304. This opening 367 is formed between the extending conductor 352 and element joint portion 354, for example. The slit 363 linearly extends to the inner side of the ground plate 304 from the opening 367. The slit 363 extends substantially vertically against the second side portion 314. Namely, the slit 363 extends in the substantially parallel direction against the third side portion 316 adjacent to the second side portion 314 along the third side portion 316. Length W12 of the slit 363 is 39 mm, for example.

A ground plate 304-3 is surrounded by the slit 363, second side portion 314, and third side portion 316 in three directions, and is separated from the ground plate 304-2. Therefore, the ground plate 304-3 is connected to the ground plate 304-2 bypassing the slit 363. Namely, the element joint portion 354 is surrounded by the slit 363.

The other configuration of the ground plate 304 is the same as with ground plate according to the second embodiment, and accordingly, description thereof will be omitted.

The first antenna 322 includes a first linear element 324, a second linear element 326, and a short-circuit element 328. At least one of the first linear element 324 and short-circuit element 328 makes up a ground terminal. The first linear element 324 and short-circuit element 328 makes up the base 330 of the first antenna 322.

The first linear element 324 is disposed between the extending conductor 332, i.e., element facing portion and the second linear element 326, and extends in the substantially vertical direction against the first side portion 312. The first linear element 324 is disposed adjacent to the extending conductor 332. The first linear element 324 makes up a feeding portion of the first antenna 322. The first linear element 324 is connected to the second linear element 326.

The second linear element 326 serves as a radiating element of the first antenna 322. The second linear element 326 extends in the substantially parallel direction against the first side portion 312. The second linear element 326 is connected to the first linear element 324, and also connected to the short-circuit element 328 at one edge portion thereof.

The short-circuit element 328 is disposed between the first side portion 312 and the second linear element 326, and disposed in the vicinity of the first linear element 324. The short-circuit element 328 extends in the substantially vertical direction against the first side portion 312. The short-circuit element 328 is connected to the second linear element 326 and the element joint portion 334 of the ground plate 304, and connects the second linear element 326 and ground plate 304. The short-circuit element 328 shorts the first antenna 322 to the ground plate 304.

The first antenna 322 forms an inverted-F antenna using the first linear element 324, second linear element 326, and short-circuit element 328.

The second antenna 342 includes the first linear element 344, second linear element 346, and short-circuit element 348. At least one of the first linear element 344 and short-circuit element 348 makes up a ground terminal. The first linear element 344 and short-circuit element 348 makes up the base 350 of the second antenna 342.

The first linear element 344 is disposed between the extending conductor 352, i.e., the element facing portion and the second linear element 346, and extends in the substantially vertical direction against the second side portion 314. The first linear element 344 is disposed adjacent to the extending conductor 352. The first linear element 344 makes up a feeding portion of the second antenna 342. The first linear element 344 is connected to the second linear element 346.

The second linear element 346 serves as a radiating element of the second antenna 342. The second linear element 346 extends in the substantially parallel direction against the second side portion 314. The second linear element 346 includes a meandering portion 374 at the intermediate portion of the element. With respect to the meandering portion 374, the linear element 346 bends at an angle, and is meandering. Meandering of the element is not restricted to the intermediate portion, and may be at the edge portion or near the edge portion of the second linear element 346. The second linear element 346 is connected to the first linear element 344, and also connected to the short-circuit element 348.

The short-circuit element 348 is disposed between the second side portion 314 and the second linear element 346, and disposed in the vicinity of the first linear element 344. The short-circuit element 348 extends in the substantially vertical direction against the second side portion 314. The short-circuit element 348 is connected to the second linear element 346 and an element joint portion 354 of the ground plate 304, and connects the second linear element 346 and ground plate 304. The short-circuit element 348 shorts the first antenna 342 to the ground plate 304.

The second antenna 342 forms an inverted-F antenna using the first linear element 344, second linear element 346, and short-circuit element 348.

Lamellar dielectrics 392 and 394 are disposed on the tip portion of the first antenna 322 and the tip portion of the second antenna 342. The permittivity (Cr) of the dielectrics 392 and 394 is 3, for example. The dielectrics 392 and 394 are overlaid on the antennas 322 and 342 on the dielectric board 106. With respect to the first and second antennas 322 and 342, disposing the dielectrics 392 and 394 on the first and second antennas 322 and 342 enables the frequency of radio waves to be received at the first and second antennas 322 and 342 to be decreased due to dielectric wavelength reduction effects. Namely, antenna length may be reduced using the dielectrics 392 and 394.

The other configuration is the same as with the second embodiment, and accordingly, description thereof will be omitted.

Figures 26A, 26B:
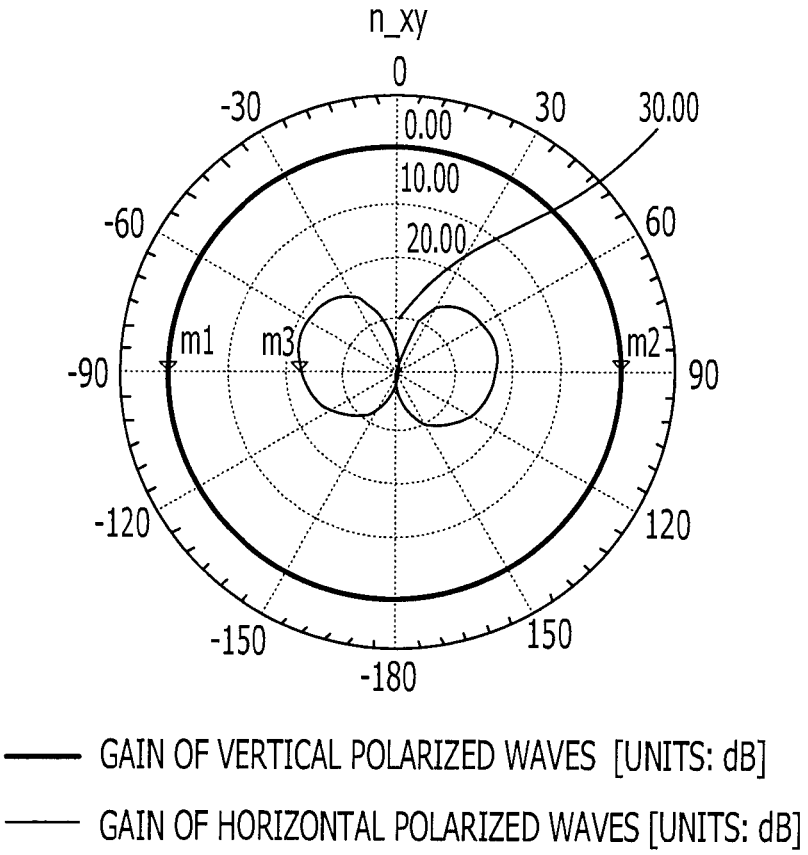
FIGS. 26A and 26B are diagrams illustrating an example of directivity in an X-Y plane at the time of feeding a first antenna.
Figures 27A, 27B:
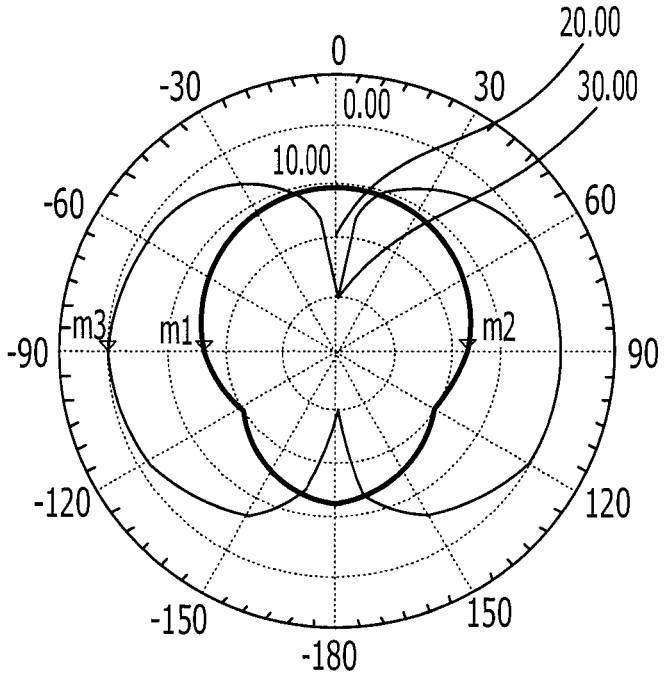
FIGS. 27A and 27B are diagrams illustrating an example of directivity in an X-Y plane at the time of feeding a second antenna.

Next, the directivity and correlation coefficient of the antenna device will be described with reference to FIGS. 26A, 26B, 27A, and 27B. FIGS. 26A and 26B are diagrams illustrating an example of directivity in the X-Y plane at the time of feeding the first antenna 322. FIGS. 27A and 27B are diagrams illustrating an example of directivity in the X-Y plane at the time of feeding the second antenna 342.

The directivity patterns illustrated in FIGS. 26A, 26B, 27A, and 27B are results of analysis using simulation regarding the antenna device 302 illustrated in FIG. 25. At the time of analysis, an FR4 board was employed as the dielectric board 106. The parameters are as follows.

Vertical Dimension of Ground Plate: GH: 53 mm
Horizontal Dimension of Ground Plate GW: 67 mm
Permittivity of Dielectric Board ∈r: 4.4
Dielectric Tangent of Dielectric Board tan δ: 0.02
Thickness of Dielectric Board h: 0.8 mm
Thickness of Inner Layer Metal Foil t: 0.035 mm
Length of Slit 362 W11: 39 mm
Length of Slit 363 W12: 39 mm
Width of Slit: 1 mm The analysis conditions are set as follows.

Analysis Frequency: 1 GHz

With respect to the directivity pattern illustrated in FIG. 26A, gain in vertical polarized waves is high as compared to horizontal polarized waves. For example, with the data illustrated in FIG. 26B, the magnitude of horizontal polarized waves at the mark m3 is −21.5728 dB. In comparison, the magnitude of vertical polarized waves at the mark m1 is 0.5923 dB, and the magnitude of vertical polarized waves at the mark m2 is 0.5526 dB.

In the directivity pattern illustrated in FIG. 27A, gain in horizontal polarized waves is high as compared to vertical polarized waves. For example, with the data illustrated in FIG. 27B, the magnitude of vertical polarized waves at the mark m1 is −16.2955 dB, and the magnitude of vertical polarized waves at the mark m2 is −16.2908 dB. On the other hand, the magnitude of horizontal polarized waves at the mark m3 is 0.9617 dB.

The correlation coefficient of the antenna device 302 illustrated in FIG. 25 was 0.01 according to calculation using the already-described Expression 1.

For comparison, the directivity pattern and correlation coefficient of an antenna device to which no slit is provided will be described with reference to FIGS. 28, 29A, 29B, 30A, and 30B.

Figure 28:
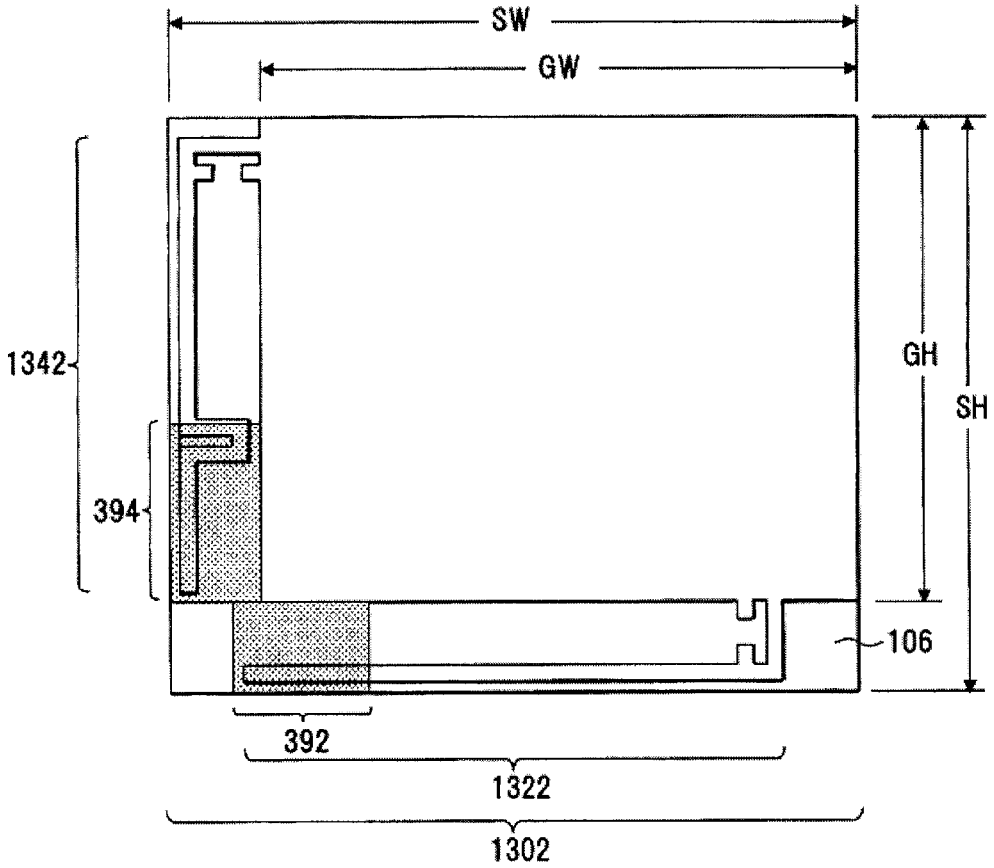
FIG. 28 is a diagram illustrating an example of an antenna device having no slit.
Figures 29A, 29B:
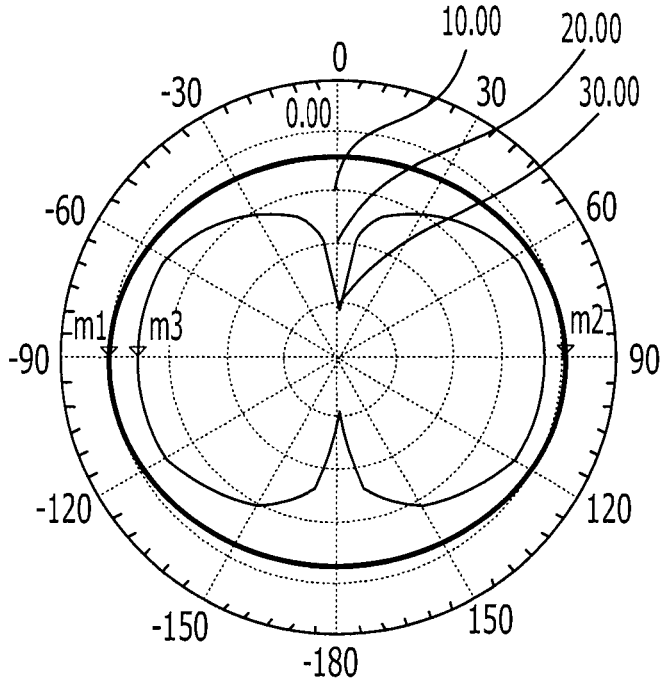
FIGS. 29A and 29B are diagrams illustrating an example of directivity in an X-Y plane at the time of feeding a first antenna.
Figures 30A, 30B:
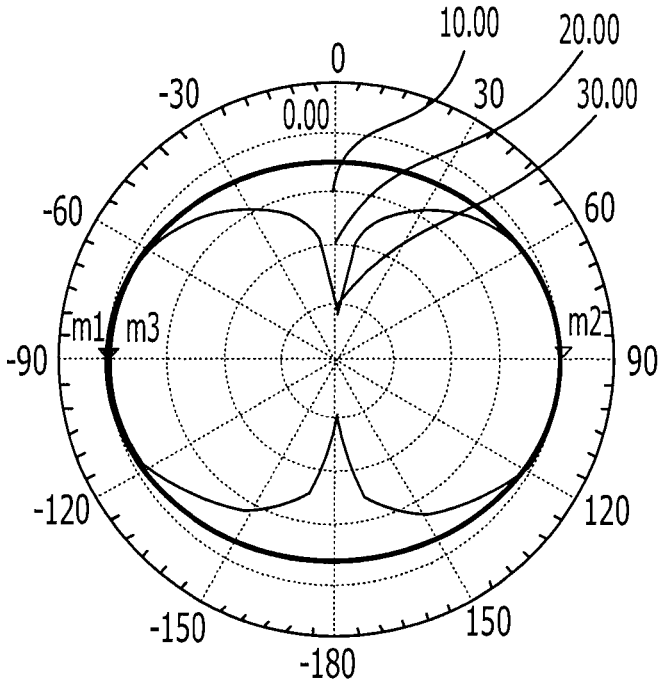
FIGS. 30A and 30B are diagrams illustrating an example of directivity in an X-Y plane at the time of feeding a second antenna.

The directivity patterns illustrated in FIGS. 29A and 30A are results of analysis using simulation regarding an antenna device 1302 illustrated in FIG. 28. The antenna device 1302 is the same as the antenna device 302 illustrated in FIG. 25 except that no slit is disposed, and the lengths of antennas 1322 and 1342 have been adjusted, and accordingly, description thereof will be omitted.

With respect to the directivity pattern illustrated in FIG. 29A, as compared to a case where a slit is included, difference between gain of horizontal polarized waves and gain of vertical polarized waves is reduced. For example, with the data illustrated in FIG. 29B, the magnitude of horizontal polarized waves at the mark m3 is −2.6329 dB. In comparison, the magnitude of vertical polarized waves at the mark m1 is −0.1043 dB, and the magnitude of vertical polarized waves at the mark m2 is −0.1043 dB.

With respect to the directivity pattern illustrated in FIG. 30A, as compared to a case where a slit is included, the difference between gain of horizontal polarized waves and gain of vertical polarized waves is reduced. For example, with the data illustrated in FIG. 30B, the magnitude of vertical polarized waves at the mark m1 is −1.1779 dB, and the magnitude of vertical polarized waves at the mark m2 is −1.2191 dB. On the other hand, the magnitude of horizontal polarized waves at the mark m3 is −1.0947 dB.

The correlation coefficient of the antenna device 1302 illustrated in FIG. 28 was 0.93 according to calculation using the already-described Expression 1.

According to the analysis results illustrated in FIGS. 26A, 26B, 27A, and 27B, in the event that a slit was provided, vertical polarized waves were strongly radiated from the first antenna 322, and horizontal polarized waves were strongly radiated from the second antenna 342. In comparison, according to the analysis results illustrated in FIGS. 29A, 29B, 30A, and 30B, in the event that no slit was provided, both of vertical polarized waves and horizontal polarized waves were strongly radiated from both of the first antenna 1322 and second antenna 1342.

Specifically, with the antenna device 302 in which the slit was provided to the ground plate 304, at the time of feeding the first antenna 322, horizontal polarized waves became strong within the horizontal plane. At the time of feeding the second antenna 342, vertical polarized waves became strong within the horizontal plane. Also, with the antenna device 302, the correlation coefficient deteriorated even when feeding any antenna of the first antenna 322 and second antenna 342. The antenna device 302 including the slit was high in polarized wave diversity effects as compared to the antenna device 1302 including no slit.

Other Embodiments

Figure 31:
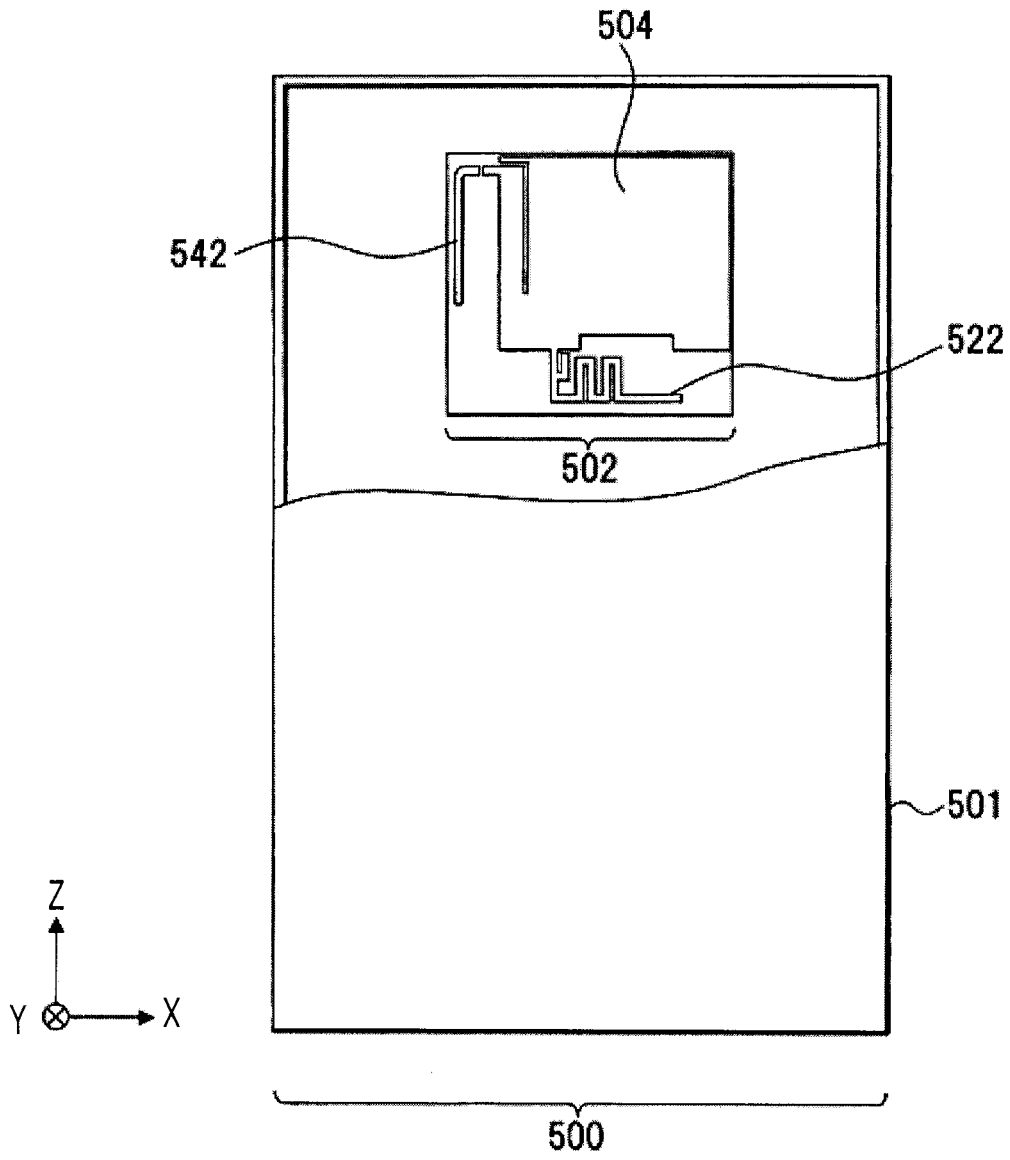
FIG. 31 is a diagram illustrating an example of an electronic apparatus according to another embodiment.

Another embodiment will be described with reference to FIG. 31. FIG. 31 is a diagram illustrating an example of an electronic apparatus according to another embodiment.

An electronic apparatus 500 illustrated in FIG. 31 has a wireless communication function, and includes an antenna device 502 within a casing 501. The antenna device 502 is an antenna device such as the already-described antenna devices 2, 102, 202, 302, and so forth. A ground plate 504, antennas 522 and 542 of the antenna device 502 are disposed in substantially parallel with the surface on the front side of the electronic apparatus 500. Also, the antenna device 502 is disposed on the front face side of the electronic apparatus 500, for example. Radio waves are readily received or transmitted by disposing the antenna device 502 on the front face side of the electronic apparatus 500. The electronic apparatus 500 may be employed as an electronic apparatus 500 making up a smart network. The electronic apparatus 500 makes up a sensor, and transmits sensed information or collected information from the antenna device 502, and obtains information from an external electronic apparatus via the antenna device 502. Employing the antenna devices 2, 102, 202, 302, and so forth according to the present disclosure enables improvement in communication quality with external devices. Also, the antenna devices 2, 102, 202, and 302 according to the present disclosure use an unbalanced antenna, for example. Therefore, the size of the antenna device may be reduced. Also, for example, the antenna devices 2, 102, 202, and 302 may be configured in a planar shape. The antenna device 502 may be disposed in a restricted area of the electronic apparatus 500. Alternatively, the electronic apparatus 500 may be suppressed from increasing in size.

With regard to the above-mentioned embodiments, particular features and modifications will be listed.

(1) In the above-mentioned embodiments, a substantially rectangular ground plate has been employed, but the present disclosure is not restricted to such a configuration. For example, an arrangement may be made wherein a backward portion is provided to one side or multiple sides of the rectangular ground plate to make up the shape of the ground plate having five or more corners. Alternatively, an arrangement may be made wherein one or multiple corners of the rectangular ground plate are cut off to make up the shape of the ground plate having five or more corners. Note that, in the event that the degree of deformation for these shapes is small, and the ground plate has a shape externally recalling a rectangle, the shape of this ground plate may be regarded as a generally rectangular shape. Even when the degree of deformation for these shapes is great, the correlation coefficient may be lowered by slits.

Figure 32:
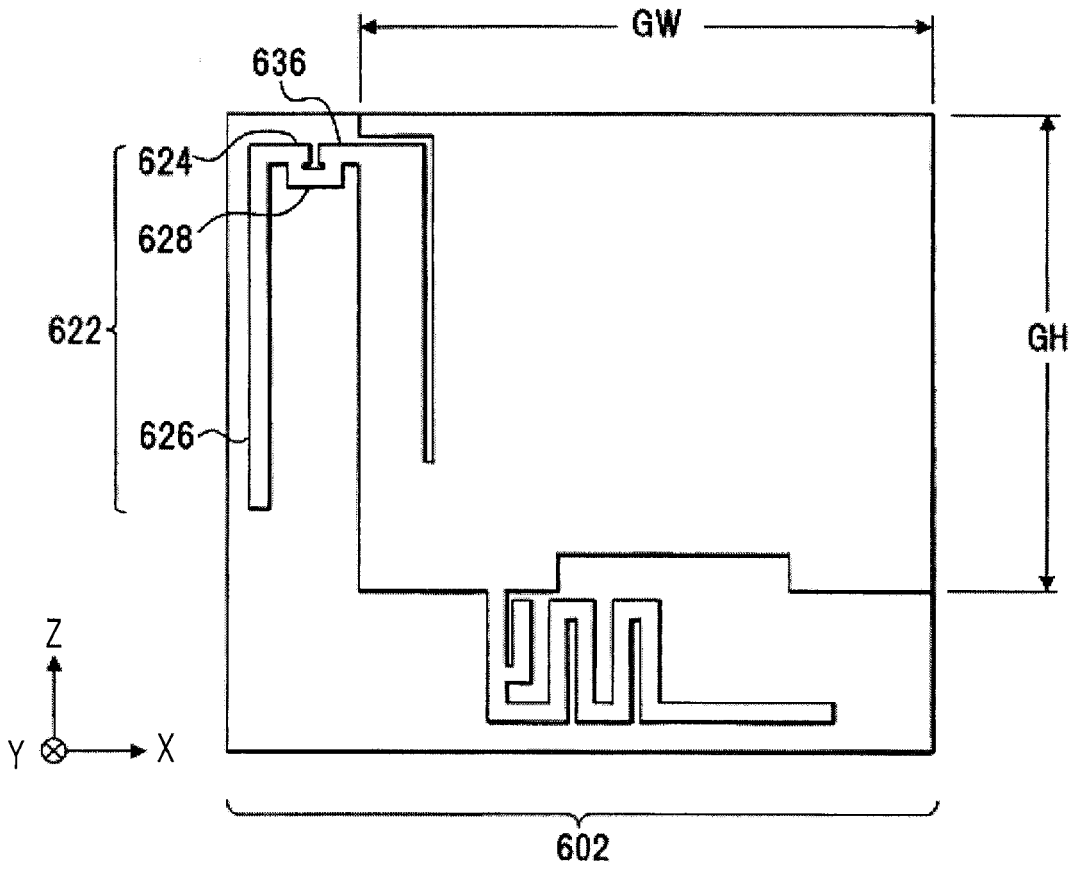
FIG. 32 is a diagram illustrating an example of another antenna device.

(2) In the above-mentioned embodiments, an inverted-F antenna or inverted-L antenna has been employed, but an antenna such as an antenna device 602 illustrated in FIG. 32 may be employed. Specifically, with a first antenna 622, a short-circuit element 628 may short a first linear element 624 and a facing portion 636. Even with such a configuration, impedance of the first antenna 622 may be adjusted by the short-circuit element 628.

Figure 33:
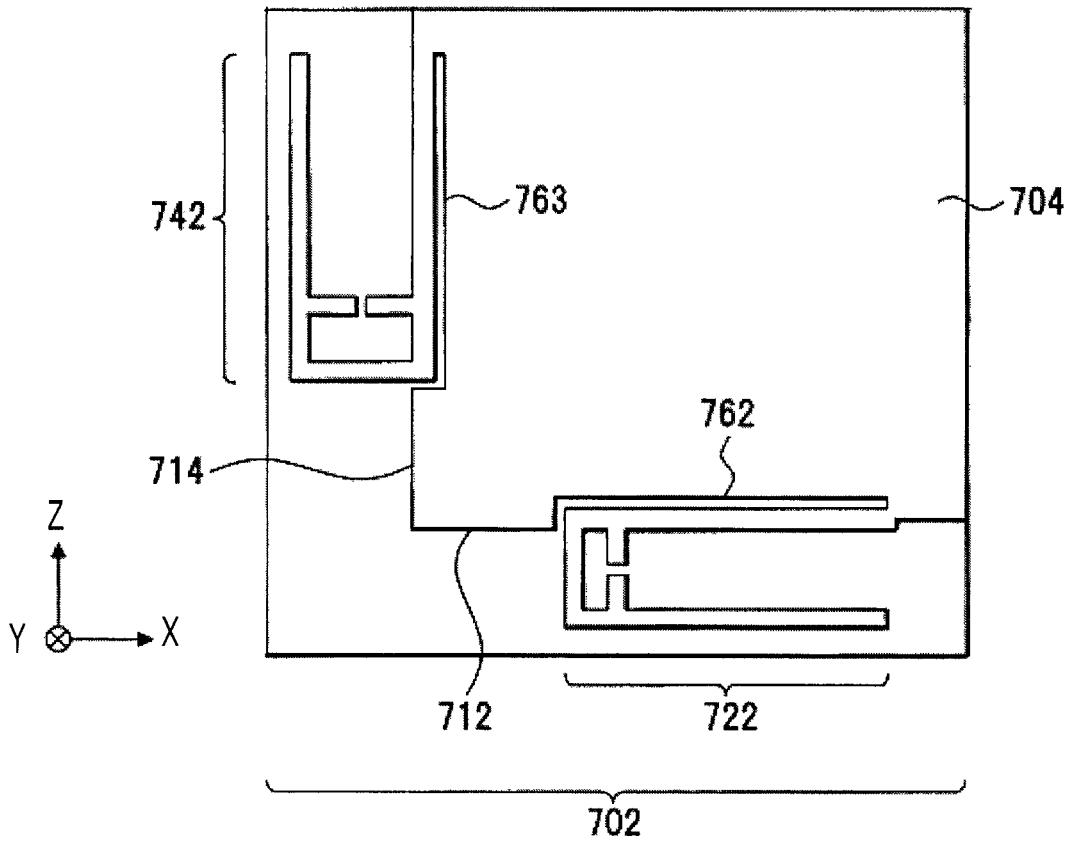
FIG. 33 is a diagram illustrating an example of another antenna device.

(3) With respect to the fourth embodiment, the slit 362 was disposed corresponding to the first antenna 322, and the slit 363 was disposed corresponding to the second antenna 342. The slits 362 and 363 were slits which linearly extend. As for such an embodiment, for example, with an antenna device 702 illustrated in FIG. 33, various modifications may be made such as changing the positions of antennas 722 and 742, changing the directions where the antennas 722 and 742 extend, and so forth. Also, various modifications may be made such as bending slits 762 and 763 formed in a ground plate 704 so as to extend along the antenna corresponding to each slit, and so forth. These modifications may be made not only regarding the fourth embodiment but also regarding other embodiments.

(4) In the above-mentioned embodiments, a slit bent at one location or a linear slit has been employed, but the present disclosure is not restricted to such slits. The edge portion of a slit has to be disposed in the already-described facing portion or adjacent portion of the facing portion, and to be disposed so that the slit surrounds a portion or all areas of the facing portion. For example, a slit may be bent at two or more locations, or may form a curved portion. Even with such a configuration, coupling between antennas may be suppressed by the slit.

(5) In the above-mentioned embodiments, a slit extending from an opening is extent substantially vertically against a side where the opening is formed, but the present disclosure is not restricted to such a direction. For example, the slit may be extent in an inclination direction against the side where the opening is formed. Even with such a configuration, coupling between antennas may be suppressed by the slit.

(6) In the above-mentioned embodiments, dimensions regarding an antenna device have specifically been exemplified. These dimensions are exemplifications, and the present disclosure is not restricted by such dimensions.

(7) In the above-mentioned embodiments, an electronic apparatus making up a smart network has been exemplified as an electronic apparatus, but the present disclosure is not restricted to such an exemplification. For example, the electronic apparatus may be a mobile terminal such as a cellular phone, smart phone, personal digital assistant (PDA), or the like, PC (Personal Computer), camera, video camera, or the like.

(8) In the above-mentioned embodiments, a slit is disposed in an adjacent portion, for example. This adjacent portion may not necessarily directly be in contact with an element facing portion, element joint portion, or facing portion. For example, the slit and adjacent portion may have close distance to the extent that they are adjacent to each other via a ground plate. For example, the slit and adjacent portion may be separated with distance such as the width of an element facing portion, element joint portion, or facing portion.

In the antenna device and electronic apparatus according to the above-mentioned embodiments, in the event of having powered one of the antennas, outflow of current to the non-powered antenna may be suppressed, and radiation of undesired radio waves at the non-powered antenna may be suppressed.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An antenna device, comprising:

a ground plate to which first and second antennas are connected, each antenna including a radiating element and a ground terminal, with one of the first and second antennas being powered, the first antenna and the second antenna being each disposed in adjacent sides of the ground plate in a same plane as that of the ground plate, the adjacent sides being substantially orthogonal to each other, wherein the ground plate is configured to include:

a slit comprising a first slit portion and a second slit portion, the slit being configured to reduce coupling of the first and second antennas, the first slit portion extending from a portion in which the ground terminal of one antenna of the first and second antennas is connected to the ground plate, in a direction along the ground terminal, and the second slit portion extending the first slit portion in a direction along the radiating element and a first side portion of the ground plate, and a conductor extending from the ground plate in a direction toward the one antenna as a part of the ground terminal of the one antenna, wherein a combined length of the first slit portion and second slit portion is in a range from 0.1 wavelength to 0.2 wavelength for a radio wave used by the antenna device.

2. The antenna device according to claim 1, further comprising:

a dielectric board connected to the ground plate, the ground plate being connected to the first and second antennas.

3. The antenna device according to claim 1, further comprising:

a dielectric board upon which the ground plate and the first and second antennas are disposed; and a microstrip line formed on a surface of the dielectric board, wherein the first antenna or the second antenna is powered via the microstrip line.

4. The antenna device according to claim 1, wherein the first and second antennas comprise inverted-F antennas, inverted-L antennas, or monopole antennas.

5. An electronic apparatus comprising:

a casing; and an antenna device disposed in the casing, the antenna device including a ground plate, to which first and second antennas, each including a radiating element and a ground terminal, are connected, with one of the first and second antennas being powered, the first antenna and the second antenna being each disposed in adjacent sides of the ground plate in a same plane as that of the ground plate, the adjacent sides being substantially orthogonal to each other, wherein the ground plate includes:

a slit and comprising a first slit portion and a second slit portion, the slit being configured to reduce coupling of the first and second antennas, the first slit portion extending from a portion in which the ground terminal of one antenna of the first and second antennas is connected to the ground plate, in a direction along the ground terminal, and the second slit portion extending the first slit portion, in a direction along the radiating element and a first side portion of the ground plate, and a conductor extending from the ground plate in a direction toward the one antenna as a part of the ground terminal of the one antenna, wherein a combined length of the first slit portion and second slit portion is in a range from 0.1 wavelength to 0.2 wavelength for a radio wave used by the antenna device.

6. The electronic apparatus according to claim 5, further comprising:

a dielectric board connected to the ground plate, the ground plate being connected to the first and second antennas.

7. The electronic apparatus according to claim 5, further comprising:

a dielectric board upon which the ground plate and the first and second antennas are disposed; and a microstrip line formed on a surface of the dielectric board, wherein the first antenna or the second antenna is powered via the microstrip line.

8. The electronic apparatus according to claim 5, wherein the first and second antennas comprise inverted-F antennas, inverted-L antennas, or monopole antennas.

9. A wireless communication method, comprising:

powering one of first and second antennas each including a radiating element and a ground terminal, the first and second antennas being connected to a ground plate, the first antenna and the second antenna being each disposed in adjacent sides of the ground plate in a same plane as that of the ground plate, the adjacent sides being substantially orthogonal to each other, wherein the ground plate includes:

a slit comprising a first slit portion and a second slit portion, the slit being configured to reduce coupling between the first antenna and the second antenna, the first slit portion extending from a portion in which the ground terminal of one antenna of the first and second antennas is connected to the ground plate, in a direction along the ground terminal, the second slit portion extending the first slit portion in a direction along the radiating element and a first side portion of the ground plate, and a conductor extending from the ground plate in a direction toward the one antenna as a part of the ground terminal of the one antenna; and performing at least one of transmission and reception of a radio wave, via the first and second antennas, wherein a combined length of the first slit portion and second slit portion is in a range from 0.1 wavelength to 0.2 wavelength for a radio wave used by the antenna device.

10. The wireless communication method according to claim 9, wherein a dielectric board is connected to the ground plate, and the ground plate is connected to the first and second antennas.

11. The wireless communication method according to claim 9, wherein:

the ground plate and the first and second antennas are disposed upon a dielectric board, a microstrip line is formed on a surface of the dielectric board, and the powering includes powering of the first antenna or the second antenna via the microstrip line.

12. The wireless communication method according to claim 9, wherein the first and second antennas comprise inverted-F antennas, inverted-L antennas, or monopole antennas.

* * * * *